US011645964B2

(12) United States Patent
Jang

(10) Patent No.: US 11,645,964 B2
(45) Date of Patent: May 9, 2023

(54) DISPLAY DEVICE HAVING COMPENSATOR THAT SETS GRAYSCALE VALUES

(71) Applicant: Samsung Display Co., LTD., Yongin-si (KR)

(72) Inventor: Dae Gwang Jang, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/480,676

(22) Filed: Sep. 21, 2021

(65) Prior Publication Data

US 2022/0301481 A1 Sep. 22, 2022

(30) Foreign Application Priority Data

Mar. 17, 2021 (KR) ..... 10-2021-0034920

(51) Int. Cl.
*G09G 3/32* (2016.01)
*G09G 3/20* (2006.01)

(52) U.S. Cl.
CPC ..... *G09G 3/2051* (2013.01); *G09G 3/32* (2013.01); *G09G 2300/0842* (2013.01);
(Continued)

(58) Field of Classification Search
CPC .. G09G 3/2007; G09G 3/2044; G09G 3/2051; G09G 3/2055; G09G 3/32–3291; G09G 2300/0443; G09G 2300/0452; G09G 2300/0465; G09G 2300/0842; G09G 2300/0871; G09G 2310/0243; G09G 2310/0267; G09G 2310/027; G09G 2310/0289; G09G 2310/06;
(Continued)

(56) References Cited

U.S. PATENT DOCUMENTS 7,928,452 B2 4/2011 Naito et al.
11,127,345 B1 * 9/2021 Seo ..... G09G 3/2003
(Continued)

FOREIGN PATENT DOCUMENTS

KR 10-1453082 10/2014
KR 10-1570403 11/2015

OTHER PUBLICATIONS

Lilin Liu et al., "Efficiency degradation behaviors of current/thermal co-stressed GaN-based blue light emitting diodes with vertical-structure", Journal of Applied Physics, May 10, 2012, pp. 1-9, vol. 111, 093110.

*Primary Examiner* — Nathan Danielsen
(74) *Attorney, Agent, or Firm* — Kile Park Reed & Houtteman PLLC

(57) ABSTRACT

A display device includes a display panel. The display panel includes a pixel including a light emitting element. A compensator calculates a current stress of the light emitting element based on input grayscale values sequentially provided for the pixel during a specific time and generates a first output grayscale value by compensating for a first input grayscale value provided at a current time point based on the current stress. A driver generates a data signal based on the first output grayscale value and supplies the data signal to the pixel. The compensator sets the first output grayscale value to be less than the first input grayscale value in case that the input grayscale values are greater than a reference grayscale value.

17 Claims, 11 Drawing Sheets

(52) U.S. Cl.
CPC ..... *G09G 2310/027* (2013.01); *G09G 2310/0267* (2013.01); *G09G 2310/08* (2013.01); *G09G 2320/0233* (2013.01); *G09G 2320/048* (2013.01); *G09G 2360/16* (2013.01)

(58) Field of Classification Search
CPC ..... G09G 2310/08; G09G 2320/0233; G09G 2320/0242; G09G 2320/04; G09G 2320/043–048; G09G 2360/16
See application file for complete search history.

(56) References Cited

U.S. PATENT DOCUMENTS

| | | | | |
|---|---|---|---|---|
| 2008/0309234 | A1 | 12/2008 | Cho et al. | |
| 2012/0256971 | A1* | 10/2012 | Shin | G09G 3/3233 345/77 |
| 2016/0277657 | A1* | 9/2016 | Zeng | G09G 3/2011 |
| 2017/0032743 | A1* | 2/2017 | Lee | G09G 3/3233 |
| 2017/0206819 | A1* | 7/2017 | Pyo | G09G 3/3225 |
| 2018/0182286 | A1* | 6/2018 | Ahmed | G09G 3/3283 |
| 2020/0020274 | A1* | 1/2020 | Yue | G09G 3/32 |
| 2020/0035046 | A1* | 1/2020 | Luke | H01M 10/4257 |
| 2022/0179611 | A1* | 6/2022 | Noh | G09G 5/10 |

* cited by examiner

DISPLAY DEVICE HAVING COMPENSATOR THAT SETS GRAYSCALE VALUES

CROSS-REFERENCE TO RELATED APPLICATION(S)

This application claims priority to and benefits of Korean Patent Application No. 10-2021-0034920 under 35 U.S.C. § 119, filed on Mar. 17, 2021 in the Korean Intellectual Property Office (KIPO), the entire contents of which are herein incorporated by reference.

BACKGROUND

1. Technical Field

The disclosure relates to a display device.

2. Description of the Related Art

As interest in information display is increasing and demand for using portable information media is increasing, demand for and commercialization of display devices continues to increase.

SUMMARY

An aspect of the disclosure is to provide a display device capable of displaying an image with a uniform luminance.

A display device according to an embodiment of the disclosure may include a display panel including a pixel including a light emitting element, a compensator that calculates a current stress of the light emitting element based on input grayscale values sequentially provided for the pixel during a specific time and generates a first output grayscale value by compensating for a first input grayscale value provided at a current time point based on the current stress, and a driver that generates a data signal based on the first output grayscale value and supplies the data signal to the pixel. The compensator may set the first output grayscale value to be less than the first input grayscale value in case that the input grayscale values are greater than a reference grayscale value.

In an embodiment, the light emitting element may include a material of an inorganic crystal structure.

In an embodiment, the specific time may be a period within several minutes based on the current time point.

In an embodiment, the compensator may determine that the current stress is greater than a reference current stress in case that the input grayscale values are greater than the reference grayscale value, and set the first output grayscale value to be less than the first input grayscale value.

In an embodiment, the compensator may determine that the current stress may be less than a reference current stress in case that the input grayscale values are less than the reference grayscale value, and set the first output grayscale value to be greater than the first input grayscale value.

In an embodiment, the compensator may predict a change of luminous efficiency of the light emitting element based on the current stress of the light emitting element, and may compensate for the first input grayscale value based on the change of the luminous efficiency. The compensator may determine that the luminous efficiency of the light emitting element increases as the current stress increases.

In an embodiment, the compensator may include a state predictor that calculates a first luminance for the first input grayscale value based on the change of the luminous efficiency of the light emitting element, a luminance correction amount calculator that calculates a first luminance correction amount by comparing a target luminance and the first luminance, a correction grayscale calculator that calculates a correction grayscale based on the first luminance correction amount, and a grayscale corrector that calculates the first output grayscale value by correcting the first input grayscale value based on the correction grayscale.

In an embodiment, the state predictor may calculate the current stress by summing the input grayscale values.

In an embodiment, the state predictor may calculate the current stress by weighting and summing the input grayscale values as time passes.

In an embodiment, the luminance correction amount calculator may include a first calculator that calculates a second luminance correction amount by comparing the target luminance and the first luminance, a comparator that outputs a first comparison result by comparing the second luminance correction amount and a luminance correction request range, and a second calculator that calculates the first luminance correction amount based on the first comparison result.

The second calculator may determine a third luminance correction amount within the luminance correction request range as the first luminance correction amount in case that the correction amount is out of the luminance correction request range, and an output luminance of the pixel may be different from the target luminance corresponding to the first input grayscale value.

In an embodiment, the display panel may further include an adjacent pixel adjacent to the pixel, and the luminance correction amount calculator may calculate a luminance correction amount of the adjacent pixel based on a difference between the third luminance correction amount and the first luminance correction amount before being determined in case that the third luminance correction amount is determined as the first luminance correction amount for the pixel.

In an embodiment, the compensator may further include a dithering pattern generator that generates a dithering pattern periodically including a negative additional correction grayscale, the grayscale corrector may calculate the first output grayscale value by correcting the first input grayscale value based on the correction grayscale and the dithering pattern, and a luminance of the pixel may be lower than the target luminance as time passes due to the dithering pattern.

In an embodiment, the dithering pattern may include the negative additional correction grayscale and a positive additional correction grayscale, and the luminance of the pixel may be lower or higher than the target luminance as time passes due to the dithering pattern.

In an embodiment, the compensator may include a state predictor that calculates a first luminance for the first input grayscale value based on the change of the luminous efficiency of the light emitting element, and a grayscale corrector that calculates the first output grayscale value based on a compensation lookup table, and the compensation lookup table may include information on the first input grayscale value and the first output grayscale value respectively corresponding to the first luminance.

A display device according to an embodiment of the disclosure may include a display panel including a pixel including an inorganic light emitting element, a compensator that generates a first output grayscale value by compensating for a first input grayscale value provided at a current time point, based on the input grayscale values sequentially provided for the pixel during a specific time, and a driver that generates a data signal based on the first output grayscale value and supplies the data signal to the pixel. The compensator may set the first output grayscale value to be less than the first input grayscale value in case that the input grayscale values are greater than a reference grayscale value.

In an embodiment, the specific time may be a period within several minutes based on the current time point.

In an embodiment, the compensator may set the first output grayscale value to be greater than the first input grayscale value in case that the input grayscale values may be less than the reference grayscale value.

The display device according to an embodiment of the disclosure may calculate the current stress of the light emitting element in the pixel based on the input grayscale values provided during the specific time, predict or calculate the change of the luminous efficiency (or a dropout rate of hydrogen in the light emitting element) of the light emitting element based on the current stress, calculate the luminance correction amount (and correction grayscale) based on the change of the luminous efficiency of the light emitting element, and convert or correct the input grayscale value into the output grayscale value based on the luminance correction amount. Therefore, even though the luminous efficiency of the pixel (or the light emitting element) may be changed due to the current stress, the pixel may emit light accurately at the target luminance, and the display device may display an image with a uniform luminance.

An effect according to an embodiment of the disclosure is not limited to the contents illustrated above, and additional various effects are included in the specification.

BRIEF DESCRIPTION OF THE DRAWINGS

The above and other features of the disclosure will become more apparent by describing in further detail embodiments thereof with reference to the accompanying drawings, in which.

DETAILED DESCRIPTION OF THE EMBODIMENTS

Figure 1:
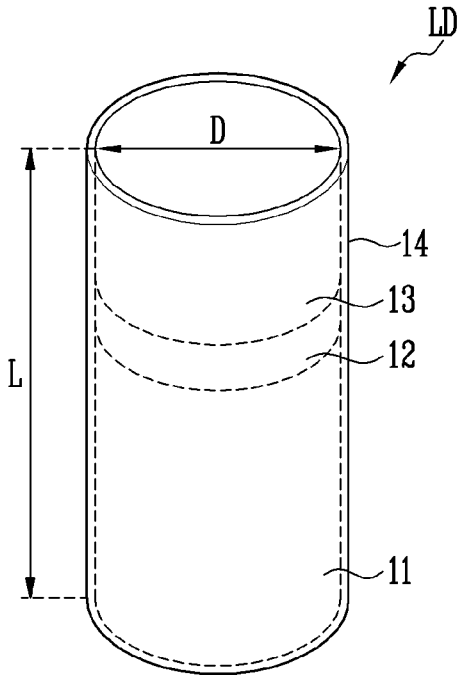
FIG. 1 is a perspective view schematically illustrating a light emitting element according to an embodiment.

The disclosure may be modified in various manners and have various forms. Therefore, specific embodiments will be illustrated in the drawings and will be described in detail in the specification. However, it should be understood that the disclosure is not intended to be limited to the disclosed specific forms, and the disclosure includes all modifications, equivalents, and substitutions within the spirit and technical scope of the disclosure.

Similar reference numerals are used for similar components in describing each drawing. In the accompanying drawings, the dimensions of the structures may be shown enlarged from the actual dimensions for the sake of clarity of the disclosure. Terms such as "first", "second", and the like may be used to describe various components, but the components should not be limited by the terms. The terms are used only for the purpose of distinguishing one component from another component. For example, without departing from the scope of the disclosure, a first component may be referred to as a second component, and similarly, a second component may also be referred to as a first component. The singular expressions include plural expressions unless the context clearly indicates otherwise.

It should be understood that in the application, terms such as "comprise", "include", "have", and the like are used to specify that there is a feature, a number, a step, an operation, a component, a part, or a combination thereof described in the specification, but do not exclude a possibility of the presence or addition of one or more other features, numbers, steps, operations, components, parts, or combinations thereof in advance. A case where a portion of a layer, a film, an area, a plate, or the like is referred to as being "on" another portion, includes not only a case where the portion may be "directly on" another portion, but also a case where there may be further another portion between the portion and another portion. In the specification, in case that a portion of a layer, a film, an area, a plate, or the like may be formed on another portion, a forming direction is not limited to an upper direction but includes forming the portion on a side surface or in a lower direction. In case that a portion of a layer, a film, an area, a plate, or the like may be formed "under" another portion, this includes not only a case where the portion may be "directly beneath" another portion but also a case where there may be further another portion between the portion and another portion.

In the specification and the claims, the phrase "at least one of" is intended to include the meaning of "at least one selected from the group of" for the purpose of its meaning and interpretation. For example, "at least one of A and B" may be understood to mean "A, B, or A and B." In the specification and the claims, the term "and/or" is intended to include any combination of the terms "and" and "or" for the purpose of its meaning and interpretation. For example, "A and/or B" may be understood to mean "A, B, or A and B."

The terms "and" and "or" may be used in the conjunctive or disjunctive sense and may be understood to be equivalent to "and/or."

It will be understood that the terms "connected to" or "coupled to" may include a physical or electrical connection or coupling.

In the application, in a case where "a component (for example, 'a first component') may be operatively or communicatively coupled with/to or "connected to" another component (for example, 'a second component'), such should be understood that the component may be directly connected to the other component, or may be connected to the other component through another component (for example, a 'third component'). In contrast, in a case where a component (for example, 'a first component') may be "directly coupled with/to or "directly connected" to another component (for example, 'a second component'), such may be understood that another component (for example, 'a third component') may not be present between the component and the other component.

As is customary in the field, some embodiments are described and illustrated in the accompanying drawings in terms of functional blocks, units, and/or modules. Those skilled in the art will appreciate that these blocks, units, and/or modules may be physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the disclosure. Further, the blocks, units, and/or modules of some embodiments may be physically combined into more complex blocks, units, and/or modules without departing from the scope of the disclosure.

Hereinafter, embodiments of the disclosure and others necessary for those skilled in the art to understand the disclosure will be described in detail with reference to the accompanying drawings. In the following description, the singular expressions include plural expressions (and vice versa) unless the context clearly dictates otherwise.

"About", "approximately", and "substantially" are inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which the disclosure pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
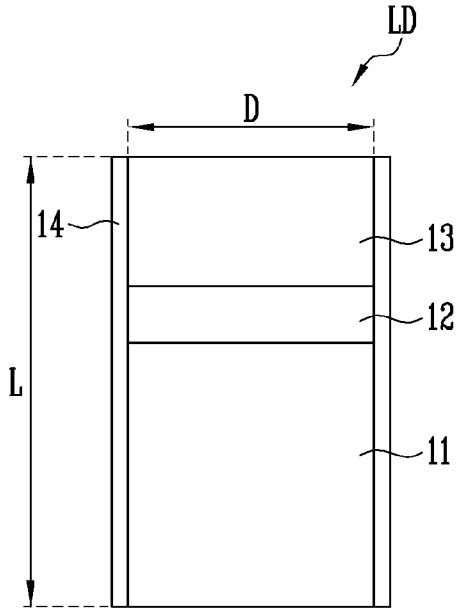
FIG. 2 is a schematic cross-sectional view of the light emitting element of FIG.

FIG. 1 is a perspective view schematically illustrating a light emitting element according to an embodiment. FIG. 2 is a schematic cross-sectional view of the light emitting element of FIG. 1.

In an embodiment of the disclosure, a type and/or a shape of the light emitting element are/is not limited to the embodiment shown in FIGS. 1 and 2.

Referring to FIGS. 1 and 2, the light emitting element LD may include a first semiconductor layer 11, a second semiconductor layer 13, and an active layer 12 interposed between the first semiconductor layer 11 and the second semiconductor layer 13. For example, the light emitting element LD may implement a light emitting stack in which the first semiconductor layer 11, the active layer 12, and the second semiconductor layer 13 may be sequentially stacked.

The light emitting element LD may be provided in a shape extending in a direction. In case that an extension direction of the light emitting element LD is referred to as a length direction, the light emitting element LD may include an end (or a lower end) and another end (or an upper end) along the extension direction. Any one of the first and second semiconductor layers 11 and 13 may be disposed at the end (or the lower end) of the light emitting element LD, and another of the first and second semiconductor layers 11 and 13 may be disposed at another end (or the upper end) of the light emitting element LD. For example, the first semiconductor layer 11 may be disposed at the end (or the lower end) of the light emitting element LD, and the second semiconductor layer 13 may be disposed another end (or the upper end) of the light emitting element LD.

The light emitting element LD may be provided in various shapes. For example, the light emitting element LD may have a rod-like shape or a bar-like shape, which may be long in the length L direction (for example, an aspect ratio may be greater than 1). In an embodiment of the disclosure, a length L of the light emitting element LD in the length direction may be greater than a diameter D (or a width of a cross period) of the light emitting element LD. The light emitting element LD may include, for example, a light emitting diode (LED) manufactured to be extremely small to have the diameter D and/or the length L of about a nano scale to about a micro scale.

The diameter D of the light emitting element LD may be about 0.5 μm to about 5 μm, and the length L may be about 1 μm to about 10 μm. However, the diameter D and the length L of the light emitting element LD are not limited thereto. A size of the light emitting element LD may be changed to satisfy a requirement condition (or a design condition) of a lighting device or a light emitting display device to which the light emitting element LD may be applied.

For example, the first semiconductor layer 11 may include at least one n-type semiconductor layer. For example, the first semiconductor layer 11 may include at least one semiconductor material among InAlGaN, GaN, AlGaN, InGaN, AlN, and InN, and may be an n-type semiconductor layer doped with a first conductive dopant (or an n-type dopant) such as Si, Ge, or Sn. However, the material configuring the first semiconductor layer 11 is not limited thereto, and other various materials may configure the first semiconductor layer 11. In an embodiment of the disclosure, the first semiconductor layer 11 may include a gallium nitride (GaN) semiconductor material doped with a first conductive dopant (or n-type dopant). The first semiconductor layer 11 may include an upper surface contacting the active layer 12 along a direction of the length L of the light emitting element LD and a lower surface exposed to the outside. The lower surface of the first semiconductor layer 11 may be the end (or the lower end) of the light emitting element LD.

The active layer 12 may be disposed on the first semiconductor layer 11 and may be formed in a single quantum well structure or a multiple quantum wells structure. For example, in case that the active layer 12 is formed in the multiple quantum wells structure, in the active layer 12, a barrier layer (not shown), a strain reinforcing layer, and a well layer may be periodically and repeatedly stacked as one unit. The strain reinforcing layer may have a lattice constant less than that of the barrier layer to further a reinforce strain, for example, a compression strain, applied to the well layer. However, a structure of the active layer 12 is not limited to the above-described embodiment.

The active layer 12 may emit light of a wavelength of about 400 nm to about 900 nm, and may use a double hetero structure. In an embodiment of the disclosure, a clad layer (not shown) doped with a conductive dopant may be formed on and/or under the active layer 12 along the direction of the length L of the light emitting element LD. For example, the clad layer may be formed of an AlGaN layer or an InAlGaN layer. According to an embodiment, a material such as AlGaN or InAlGaN may be used to form the active layer 12. Other various materials may configure the active layer 12. The active layer 12 may include a first surface contacting the first semiconductor layer 11 and a second surface contacting the second semiconductor layer 13.

In case that an electric field of a voltage or more is applied to both ends of the light emitting element LD, the light emitting element LD emits light while an electron-hole pair may be combined in the active layer 12. By controlling light emission of the light emitting element LD by using such a principle, the light emitting element LD may be used as a light source (or a light emitting source) of various light emitting devices including a pixel of the display device.

The second semiconductor layer 13 may be disposed on the second surface of the active layer 12 and may include a semiconductor layer of a type different from that of the first semiconductor layer 11. For example, the second semiconductor layer 13 may include at least one p-type semiconductor layer. For example, the second semiconductor layer 13 may include at least one semiconductor material among InAlGaN, GaN, AlGaN, InGaN, AlN, and InN, and may include a p-type semiconductor layer doped with a second conductive dopant (or a p-type dopant) such as Mg. However, the material configuring the second semiconductor layer 13 is not limited thereto, and other various materials may configure the second semiconductor layer 13. In an embodiment of the disclosure, the second semiconductor layer 13 may include a gallium nitride (GaN) semiconductor material doped with a second conductive dopant (or p-type dopant). The second semiconductor layer 13 may include a lower surface contacting the second surface of the active layer 12 along the direction of the length L of the light emitting element LD and an upper surface exposed to the outside. Here, the upper surface of the second semiconductor layer 13 may be another end (or the upper end) of the light emitting element LD.

In an embodiment of the disclosure, the first semiconductor layer 11 and the second semiconductor layer 13 may have thicknesses different from each other in the direction of the length L of the light emitting element LD. For example, the first semiconductor layer 11 may have a thickness relatively thicker than that of the second semiconductor layer 13 along the direction of the length L of the light emitting element LD. Therefore, the active layer 12 of the light emitting element LD may be positioned more adjacently to the upper surface of the second semiconductor layer 13 than to the lower surface of the first semiconductor layer 11.

Although the first semiconductor layer 11 and the second semiconductor layer 13 are shown as being configured of one layer, the disclosure is not limited thereto. In an embodiment of the disclosure, according to the material of the active layer 12, each of the first semiconductor layer 11 and the second semiconductor layer 13 may further include at least one or more layers, for example, a clad layer and/or a tensile strain barrier reducing (TSBR) layer. The TSBR layer may be a strain relief layer disposed between semiconductor layers having different lattice structures and serving as a buffer to reduce a difference of a lattice constant. The TSBR layer may be configured of a p-type semiconductor layer such as p-GaInP, p-AlInP, and p-AlGaInP, but the disclosure is not limited thereto.

According to an embodiment, the light emitting element LD may further include an additional electrode (not shown, hereinafter referred to as a "first additional electrode") disposed on the second semiconductor layer 13 in addition to the above-described first semiconductor layer 11, active layer 12, and second semiconductor layer 13. According to another embodiment, the light emitting element LD may further include another additional electrode (not shown, hereinafter referred to as a "second additional electrode") disposed at an end of the first semiconductor layer 11.

Each of the first and second additional electrodes may be an ohmic contact electrode, but the disclosure is not limited thereto. According to an embodiment, the first and second additional electrodes may be schottky contact electrodes. The first and second additional electrodes may include a conductive material. For example, the first and second additional electrodes may include an opaque metal using chromium (Cr), titanium (Ti), aluminum (Al), gold (Au), nickel (Ni), oxide thereof, alloy thereof, and the like, alone or in combination, but the disclosure is not limited thereto. According to an embodiment, the first and second additional electrodes may also include transparent conductive oxide such as indium tin oxide (ITO), indium zinc oxide (IZO), zinc oxide (ZnO), indium gallium zinc oxide (IGZO), indium tin zinc oxide (ITZO), or a combination thereof.

The materials included in the first and second additional electrodes may be the same as or different from each other. The first and second additional electrodes may be substantially transparent or translucent. Therefore, the light generated by the light emitting element LD may pass through each of the first and second additional electrodes and may be emitted to the outside of the light emitting element LD. According to an embodiment, in case that the light generated by the light emitting element LD may not pass through the first and second additional electrodes and may be emitted to the outside of the light emitting element LD through a region except for the ends of the light emitting element LD, the first and second additional electrodes may include an opaque metal.

In an embodiment of the disclosure, the light emitting element LD may further include an insulating layer 14. However, according to an embodiment, the insulating layer 14 may be omitted and/or may be provided so as to cover only a portion of the first semiconductor layer 11, the active layer 12, and the second semiconductor layer 13.

The insulating layer 14 may prevent an electrical short that may occur in case that the active layer 12 contacts a conductive material other than the first and second semiconductor layers 11 and 13. The insulating layer 14 may minimize a surface defect of the light emitting element LD to improve life and light emission efficiency of the light emitting element LD. In case that light emitting elements LD are closely disposed, the insulating layer 14 may prevent an unwanted short that may occur between the light emitting elements LD. In case that the active layer 12 may prevent an occurrence of a short with an external conductive material, presence or absence of the insulating layer 14 is not limited.

The insulating layer 14 may be provided in a form entirely surrounding an outer circumferential surface of the light emitting stack including the first semiconductor layer 11, the active layer 12, and the second semiconductor layer 13.

In the above-described embodiment, the insulating layer 14 may entirely surround the outer circumferential surface of each of the first semiconductor layer 11, the active layer 12, and the second semiconductor layer 13, but the disclosure is not limited thereto. According to an embodiment, in case that the light emitting element LD includes the first additional electrode, the insulating layer 14 may entirely surround an outer circumferential surface of each of the first semiconductor layer 11, the active layer 12, the second semiconductor layer 13, and the first additional electrode. According to another embodiment, the insulating layer 14 may not entirely surround the outer circumferential surface of the first additional electrode, or may surround only a portion of the outer circumferential surface of the first additional electrode and may not surround the remaining of the outer circumferential surface of the first additional electrode. According to an embodiment, in case that the first additional electrode is disposed at another end (or the upper end) of the light emitting element LD and the second additional electrode is disposed at an end (or the lower end) of the light emitting element LD, the insulating layer 14 may expose at least one region of each of the first and second additional electrodes.

The insulating layer 14 may include a transparent insulating material. For example, the insulating layer 14 may include at least one insulating material selected from a group of silicon oxide (SiOx), silicon nitride (SiNx), silicon oxynitride (SiOxNy), aluminum oxide (AlOx), and titanium oxide (TiOx), but the disclosure is not limited thereto, and various materials having insulating properties may be used as the material of the insulating layer 14.

According to an embodiment, the light emitting element LD may be implemented with a light emitting pattern of a core-shell structure. The above-described first semiconductor layer 11 may be positioned in a core, for example, a middle (or a center) of the light emitting element LD, the active layer 12 may be provided and/or formed in a form surrounding the outer circumferential surface of the first semiconductor layer 11, and the second semiconductor layer 13 may be provided and/or formed in a form surrounding the outer circumferential surface of the active layer 12. The light emitting element LD may further include an additional electrode (not shown) surrounding at least one side of the second semiconductor layer 13. According to an embodiment, the light emitting element LD may further include the insulating layer 14 provided on an outer circumferential surface of the light emitting pattern of the core-shell structure and including a transparent insulating material. The light emitting element LD implemented with the light emitting pattern having the core-shell structure may be manufactured by a growth method.

The above-described light emitting element LD may be used as a light emitting source (or a light source) of various display devices. The light emitting element LD may be manufactured through a surface treatment process. For example, in case that light emitting elements LD are mixed in a fluid solution (or solvent) and supplied to each pixel area (for example, a emission area of each pixel or a emission area of each sub pixel), surface treatment may be performed on each of the light emitting elements LD so that the light emitting elements LD may be uniformly sprayed without being unevenly aggregated in the solution.

A light emitting unit (or a light emitting device) including the light emitting element LD described above may be used in various types of electronic devices that require a light source, including a display device. For example, in case that light emitting elements LD are disposed in a pixel area of each pixel of a display panel, the light emitting elements LD may be used as a light source of each pixel. However, an application field of the light emitting element LD is not limited to the above-described example. For example, the light emitting element LD may be used in other types of electronic devices that require a light source, such as a lighting device. In FIGS. 1 and 2, the light emitting element LD may have the rod-like shape or the bar-like shape, or have the core-shell structure, but the light emitting element LD is not limited thereto. In other words, the light emitting element LD may have various structures within a range in which the light emitting element LD may be configured by including a material of an inorganic crystal structure such as gallium nitride (GaN). For example, the light emitting element LD may also have a flip chip structure.

Figure 3:
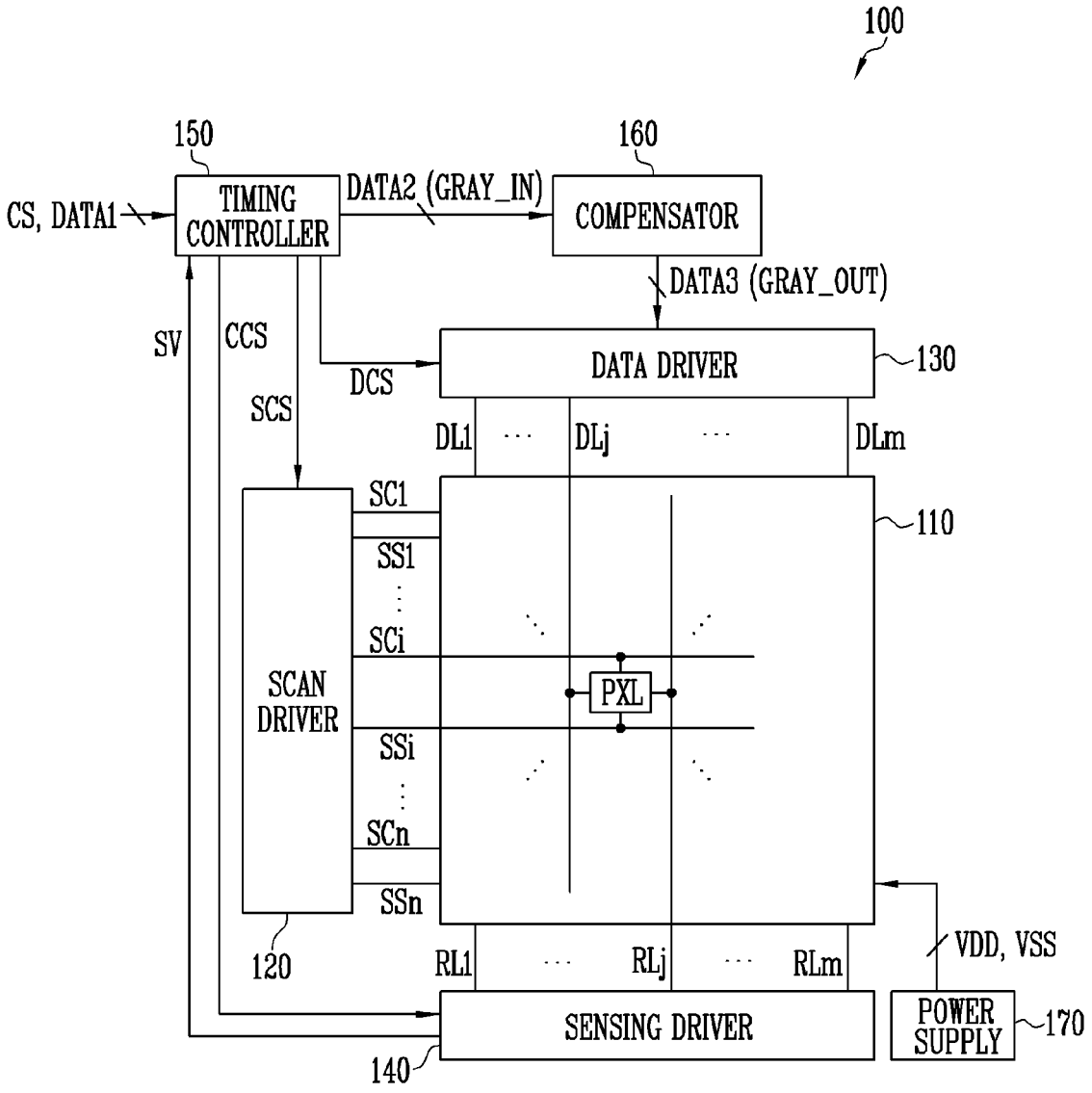
FIG. 3 is a schematic diagram illustrating a display device according to an embodiment of the disclosure.

FIG. 3 is a schematic diagram illustrating a display device according to an embodiment of the disclosure.

According to an embodiment, the display device of FIG. 3 may use the light emitting element LD described with reference to FIGS. 1 and 2 as a light source.

Referring to FIG. 3, the display device 100 may include a display unit 110 (or a display panel), a scan driver 120 (or a gate driver), a data driver 130 (or a source driver), and sensing unit 140 (or a sensing driver), a timing controller 150, a compensator 160 (or a compensation unit), and a power supply 170.

The display unit 110 may include scan lines SC1 to SCn (where n may be a positive integer) (or first scan lines), data lines DL1 to DLm (where m may be a positive integer), and a pixel PXL. The display unit 110 may further include sensing scan lines SS1 to SSn (or second scan lines), and sensing lines RL1 to RLm (or readout lines).

The pixel PXL may be provided in an area (for example, a pixel area) partitioned by the scan lines SC1 to SCn and the data lines DL1 to DLm.

The pixel PXL may be connected to a corresponding one of the scan lines SC1 to SCn and a corresponding one of the data lines DL1 to DLm. The pixel PXL may be connected to a corresponding one of the sensing scan lines SS1 to SSn and a corresponding one of the sensing lines RL1 to RLm.

The pixel PXL may include a light emitting element and at least one transistor that provides or for providing a driving current to the light emitting element.

The pixel PXL may emit light with a luminance corresponding to a data signal (or data voltage) provided from the data line (for example, a j-th data line DLj, where j may be a positive integer less than or equal to m) in response to a first scan signal provided through the scan line (for example, an i-th scan line SCi, where i may be a positive integer less than or equal to n). The pixel PXL may output characteristic information (for example, a sensing voltage or a sensing current as information on a threshold voltage/mobility of a driving transistor and/or a current-voltage characteristic of the light emitting element) through the sensing line (for example, a j-th sensing line RLj).

Detailed configuration and operation of the pixel PXL are described later with reference to FIGS. 4 and 5.

The scan driver 120 may generate the first scan signal (or first scan signals) based on a scan control signal SCS, and sequentially provide the first scan signal to the scan lines SC1 to SCn. Here, the scan control signal SCS may include a scan start signal (or scan start pulse), scan clock signals, and the like, and may be provided from the timing controller 150. For example, the scan driver 120 may include a shift register (or stage) that sequentially generates and outputs the first scan signal of a pulse type corresponding to the scan start signal of a pulse type (for example, a pulse of a gate-on voltage level) using the scan clock signals.

Similar to the first scan signal, the scan driver 120 may further generate a second scan signal (or a sensing control signal) and sequentially provide the second scan signal to the sensing scan lines SS1 to SSn.

The data driver 130 may generate data signals (or data voltages) based on a data control signal DCS provided from the timing controller 150 and compensated image data DATA3 provided from the compensator 160, and provide the data signals to the data lines DL1 to DLm. Here, the data control signal DCS may be a signal for controlling an operation of the data driver 130, and may include a load signal (or a data enable signal) and the like that instructs an output of a valid data signal.

In an embodiment, the data driver 130 may generate the data signal corresponding to a data value (or a grayscale value, for example, an output grayscale value GRAY_OUT) included in the image data DATA3 compensated by using gamma voltages. Here, the gamma voltages may be generated by the data driver 130 or may be provided from a separate gamma voltage generation circuit (for example, a gamma integrated circuit). For example, the data driver 130 may select one of the gamma voltages based on the data value and output the selected one as the data signal.

The sensing unit 140 may provide an initialization voltage to the sensing lines RL1 to RLm based on a compensation control signal CCS in a sensing mode (or a sensing period), and sense an emission characteristic of the pixel PXL through the sensing lines RL1 to RLm. Here, the compensation control signal CCS may be provided from the timing controller 150.

For reference, the display device 100 may operate in the sensing mode (or the sensing period) or a display mode (or a display period). In the display mode, the display device 100 may provide the data signal to the pixel PXL to cause the pixel PXL to emit light, and in the sensing mode, the display device 100 may sense the emission characteristic of the pixel PXL. The sensing time corresponding to the sensing mode may be allocated before/or after the display period, and in some cases, the display period and the sensing period may be included in one frame (or frame period).

The emission characteristic of the pixel PXL may include the threshold voltage and the mobility of at least one transistor (for example, the driving transistor) in the pixel PXL, and the characteristic information (for example, a current-voltage characteristic) of the light emitting element. For example, the sensing unit 140 may detect a sensing value (a sensing voltage, or a sensing current) corresponding to the emission characteristic of the pixel PXL through the sensing lines RL1 to RLm.

The sensing value (or sensing data SV including the sensing values) may be provided to the timing controller 150, and the timing controller 150 may compensate for image data DATA2 (or input image data DATA1) based on the sensing value. However, the disclosure is not limited thereto, and for example, the sensing value may be provided from the sensing unit 140 to the data driver 130, and the data driver 130 may generate the data signal based on the sensing value. For example, the data driver 130 may vary or compensate for the data signal (or data voltage) based on a change amount of the sensing value. For example, the data signal may be compensated based on the sensed emission characteristic (or the change of the emission characteristic) of the pixel PXL.

For example, the sensing unit 140 may include transistors for providing the initialization voltage to the sensing lines RL1 to RLm, an analog front end for sensing the emission characteristic (for example, the sensing current), and an analog-to-digital converter that outputs the sensing value corresponding to the emission characteristic, and the sensing value may be provided to the timing controller 150 through the analog-to-digital converter.

The timing controller 150 may receive the input image data DATA1 and a control signal CS from an outside (for example, a graphic processor), generate the scan control signal SCS and data control signal DCS based on the control signal CS, and generate the image data DATA2 by converting the input image data DATA1. Here, the control signal CS may include a vertical synchronization signal, a horizontal synchronization signal, a clock signal, and the like. For example, the timing controller 150 may convert the input image data DATA1 into the image data DATA2 having a format usable by the data driver 130.

The timing controller 150 may generate the compensation control signal CCS based on the control signal CS. The compensation control signal CCS may be provided to the sensing unit 140.

The compensator 160 may generate the compensated image data DATA3 by calculating a current stress of the light emitting element in each pixel PXL based on the image data DATA2 provided during a specific time and compensating for the image data DATA2 based on the current stress. Here, the specific time may be a time within several minutes. The current stress may correspond to an amount of current continuously flowing through the light emitting element during the specific time, and may be a short-term stress due to the image data DATA2 within several minutes, which may be distinguished from an accumulated stress of several tens of hours or more.

For reference, the light emitting element LD described with reference to FIGS. 1 and 2 may include a material of an inorganic crystal structure such as gallium nitride (GaN). For example, the light emitting element LD may be an inorganic light emitting diode, and the emission characteristic (or luminous efficiency) of the light emitting element LD may be changed by the current stress. More specifically, a lattice structure of gallium nitride (GaN) may be changed, the Fermi level of the light emitting element LD may be changed, and the emission characteristic of the light emitting element LD may be changed, by the current stress. In case that the current stress increases, the second conductive dopant (or p-type dopant) in the second semiconductor layer 13 of the light emitting element LD may be activated and p-type conductivity may be improved. Accordingly, the luminous efficiency of the light emitting element LD may be higher or improved than a reference luminous efficiency. For example, as hydrogen (H) (or a hydrogen ion (H+)) may be dropped out of Mg—H (magnesium hydride) composite formed in the light emitting element LD (or the second semiconductor layer 13) due to a relatively high current stress, a Mg dopant may be more activated or the number of accept atoms may be greater, and thus the luminous efficiency of the light emitting element LD may be increased. Here, the Mg—H composite may be formed by combining hydrogen came from a passivation layer or the like covering the light emitting element LD with the Mg dopant, and the Mg—H composite may be reversible due to the current stress. For example, as the hydrogen may be removed due to the relatively high current stress, the luminous efficiency of the light emitting element LD may increase, and a bright afterimage may occur in the image displayed on the display unit 110. On the contrary, as the hydrogen combines with the Mg dopant to form the Mg—H composite due to a relatively low current stress, the luminous efficiency of the light emitting element LD may be decreased, and a dark afterimage may occur in the image displayed on the display unit 110.

Therefore, the compensator 160 may calculate or predict the current stress (or a dropout rate of hydrogen, a change of the luminous efficiency) of the light emitting element in the pixel PXL, and compensate for the image data DATA2 based on the current stress, to cause the pixel PXL to emit light with a desired luminance.

In embodiments, the compensator 160 may calculate the current stress of the light emitting element in the pixel PXL based on input grayscale values GRAY_IN sequentially provided for the pixel PXL during the specific time, and calculate or generate the output grayscale value GRAY_OUT by compensating for the input grayscale value GRAY_IN provided at a current time point based on the current stress. Here, the input grayscale value GRAY_IN may be included in the image data DATA2, and the output grayscale value GRAY_OUT may be included in the compensated image data DATA3. For example, the compensator 160 may calculate the current stress of the light emitting element based on the input grayscale values GRAY_IN (for example, the image data DATA2) provided for each frame for each of the pixels PXL, and calculate or generate the output grayscale value GRAY_OUT by compensating for the input grayscale value GRAY_IN (for example, the image data DATA2 of a current frame) provided in the current frame based on the current stress.

For example, the compensator 160 may calculate the current stress by summing the input grayscale values GRAY_IN sequentially provided for the pixel PXL during the specific time. As another example, the compensator 160 may calculate the current stress by weighting and summing the input grayscale values GRAY_IN as time passes.

For example, in case that the current stress increases (for example, in case that the dropout rate of hydrogen is increased, and thus the luminous efficiency of the light emitting element is increased), the compensator 160 may generate the output grayscale value GRAY_OUT by decreasing the input grayscale value GRAY_IN for the pixel PXL. As another example, in case that the current stress decreases (for example, in case that the dropout rate of hydrogen is decreased, and thus the luminous efficiency of the light emitting element is decreased), the compensator 160 may generate the output grayscale value GRAY_OUT by increasing the input grayscale value GRAY_IN for the pixel PXL.

A detailed configuration of the compensator 160 is described later with reference to FIG. 8.

The power supply 170 may provide a voltage (or a high power voltage) of a first driving power VDD and a voltage (or a low power voltage) of a second driving power VSS to the display unit 110. The first driving power VDD and the second driving power VSS may have voltages required for an operation of the pixel PXL, and the first driving power VDD may have a voltage level higher than a voltage level of the second driving power VSS. The power supply 170 may provide a driving voltage to at least one of the scan driver 120, the data driver 130, and the sensing unit 140.

In FIG. 3, the scan driver 120, the data driver 130, the sensing unit 140, and the timing controller 150 may be configured independently of each other, but this is an example, and the disclosure is not limited thereto. For example, at least one of the scan driver 120, the data driver 130, the sensing unit 140, the timing controller 150, and the compensator 160 may be formed on the display unit 110, or may be implemented as an IC, mounted on a flexible circuit board, and connected to the display unit 110. For example, the scan driver 120 may be formed on the display unit 110. At least two of the scan driver 120, the data driver 130, the sensing unit 140, the timing controller 150, and the compensator 160 may be implemented as one IC. For example, the data driver 130 and the sensing unit 140 may be implemented as one integrated circuit.

As described above, the display device 100 (or the compensator 160) may calculate the current stress (the short-term stress corresponding to the amount of current flowing through the light emitting element during the specific time) of the light emitting element in each pixel, and generate the compensated image data DATA3 (or the output grayscale value GRAY_OUT) by compensating for the image data DATA2 (or the input grayscale value GRAY Ind.) based on the current stress. Therefore, even though the luminous efficiency of the pixel PXL (or the light emitting element) may be changed due to the current stress, the pixel PXL may emit light accurately with the desired luminance, and the display device 100 may display the image with a uniform luminance.

Figure 4:
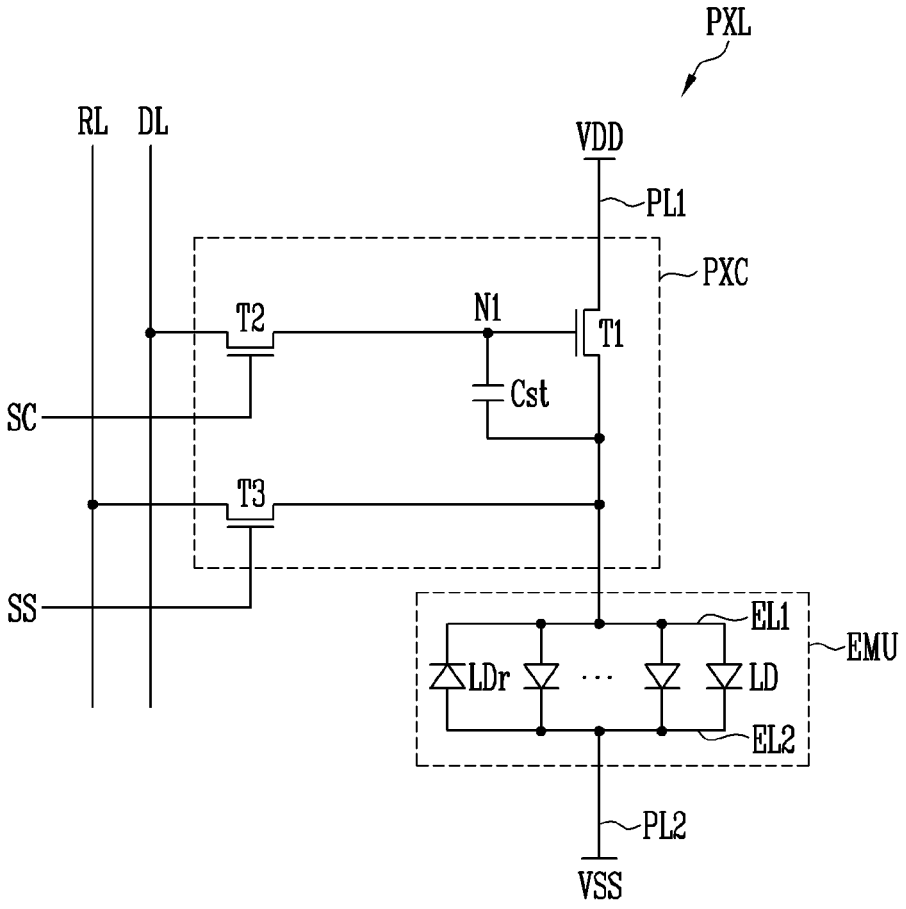
FIG. 4 is a schematic circuit diagram illustrating an example of a pixel included in the display device of FIG. 3.

FIG. 4 is a schematic circuit diagram illustrating an example of the pixel included in the display device of FIG. 3.

Referring to FIGS. 3 and 4, the pixel PXL may include a light emitting unit EMU that may generate light of a luminance corresponding to a data signal. The pixel PXL may further include a pixel circuit PXC that may drive the light emitting unit EMU.

According to an embodiment, the light emitting unit EMU may include light emitting elements LD connected in parallel between the first power line PL1 to which the voltage of the first driving power VDD may be applied and the second power line PL2 to which the voltage of second driving power VSS may be applied. For example, the light emitting unit EMU may include a first electrode EL1 connected to the first driving power VDD via the pixel circuit PXC and the first power line PL1, a second electrode EL2 connected to the second driving power VSS via the second power line PL2, and the light emitting elements LD connected in parallel in the same direction between the first and second electrodes EL1 and EL2. Here, the first electrode EL1 may be an anode, and the second electrode EL2 may be a cathode.

Each of the light emitting elements LD included in the light emitting unit EMU may include one end connected to the first driving power VDD through the first electrode EL1 and another end connected to the second driving power VSS through the second electrode EL2. The first driving power VDD and the second driving power VSS may have different potentials. For example, the first driving power VDD may be set as high potential power, and the second driving power VSS may be set as low potential power. At this time, a potential difference between the first driving power VDD and the second driving power VSS may be set as a threshold voltage or more of the light emitting elements LD during an emission period of the pixel PXL.

As described above, the respective light emitting elements LD connected in parallel in the same direction (for example, a forward direction) between the first electrode EL1 and the second electrode EL2 to which voltages of different potentials may be respectively supplied may configure respective effective light sources. Such effective light sources may be gathered to configure the light emitting unit EMU of the pixel PXL.

The light emitting elements LD of the light emitting unit EMU may emit light at a luminance corresponding to a driving current supplied through a corresponding pixel circuit PXC. For example, the pixel circuit PXC may supply a driving current corresponding to a grayscale value of corresponding frame data to the light emitting unit EMU during each frame period. The driving current supplied to the light emitting unit EMU may be divided and flow to each of the light emitting elements LD. Therefore, each of the light emitting elements LD may emit light at a luminance corresponding to the current flowing through the light emitting element LD, and thus the light emitting unit EMU may emit light of the luminance corresponding to the driving current.

An embodiment in which both ends of the light emitting elements LD may be connected in the same direction between the first and second driving power VDD and VSS is shown, but the disclosure is not limited thereto. According to an embodiment, the light emitting unit EMU may further include at least one ineffective light source, for example, a reverse light emitting element LDr, in addition to the light emitting elements LD configuring each effective light source. The reverse light emitting element LDr may be connected in parallel between the first and second electrodes EL1 and EL2 together with the light emitting elements LD configuring the effective light sources, and may be connected between the first and second electrodes EL1 and EL2 in a direction opposite to the light emitting elements LD. The reverse light emitting element LDr maintains an inactive state even though a driving voltage (for example, a driving voltage of a forward direction) may be applied between the first and second electrodes EL1 and EL2, and thus a current substantially may not flow through the reverse light emitting element LDr.

The pixel circuit PXC may be connected to a scan line SC and a data line DL of a corresponding pixel PXL. For example, in case that the pixel PXL is disposed at an i-th row and a j-th column of a display area, the pixel circuit PXC of the pixel PXL may be connected to the i-th scan line SCi (refer to FIG. 3) and the j-th data line DLj of the display area. The pixel circuit PXC may be connected to a sensing scan line SS (for example, the i-th sensing scan line SSi, refer to FIG. 3) and a sensing line RL (for example, the j-th sensing line RLj).

The pixel circuit PXC may include first to third transistors T1 to T3 and a storage capacitor Cst.

A first terminal of the first transistor T1 (driving transistor) may be connected to the first driving power VDD, and a second terminal of the first transistor T1 may be electrically connected a first electrode EL1 of each of the light emitting elements LD. A gate electrode of the first transistor T1 may be connected to a first node N1. The first transistor T1 may control an amount of driving current supplied to the light emitting elements LD in response to a voltage of the first node N1.

A first terminal of the second transistor T2 (switching transistor) may be connected to the data line DL, and a second terminal of the second transistor T2 may be connected to the first node N1. Here, the first terminal and the second terminal of the second transistor T2 may be different terminals. For example, in case that the first terminal is a source electrode, the second terminal may be a drain electrode. A gate electrode of the second transistor T2 may be connected to the scan line SC.

The second transistor T2 may be turned on in case that a scan signal of a voltage capable of turning on the second transistor T2 is supplied from the scan line SC, to electrically connect data line DL and the first node N1. At this time, the data signal of a corresponding frame may be supplied to the data line DL, and thus the data signal may be transmitted to the first node N1. The data signal transmitted to the first node N1 may be charged in the storage capacitor Cst.

The third transistor T3 may be connected between the first transistor T1 and the sensing line RL. For example, a first terminal of the third transistor T3 may be connected to the second terminal (for example, the source electrode) of the first transistor T1 connected to the first electrode EL1, and a second terminal of the third transistor T3 may be connected to the sensing line RL. A gate electrode of the third transistor T3 may be connected to the sensing scan line SS. The third transistor T3 may be turned on by a control signal of a gate-on voltage supplied to the sensing scan line SS, to electrically connect the sensing line RL and the first transistor T1.

One electrode of the storage capacitor Cst may be connected to the first node N1, and another electrode of the storage capacitor Cst may be connected to the second terminal of the first transistor T1 connected to the first electrode EL1. The storage capacitor Cst may charge a voltage corresponding to the data signal supplied to the first node N1 and maintain the charged voltage until the data signal of a next frame may be supplied.

FIG. 4 discloses an embodiment in which all of the first to third transistors T1, T2, and T3 may be N-type transistors, but the disclosure is not limited thereto. For example, at least one of the above-described first to third transistors T1, T2, and T3 may be changed to a P-type transistor. FIG. 4 discloses an embodiment in which the light emitting unit EMU may be connected between the pixel circuit PXC and the second driving power VSS, but the light emitting unit EMU may be connected between the first driving power VDD and the pixel circuit PXC.

A structure of the pixel circuit PXC may be variously changed. For example, the pixel circuit PXC may further include at least one transistor element such as a transistor element for initializing the first node N1, and/or a transistor element for controlling an emission time of the light emitting elements LD, and other circuit elements such as a boosting capacitor for boosting the voltage of the first node N1.

In FIG. 4, an embodiment in which all light emitting elements LD configuring each light emitting unit EMU may be connected in parallel is shown, but the disclosure is not limited thereto. According to an embodiment, the light emitting unit EMU may be configured to include at least one serial stage including light emitting elements LD connected in parallel with each other. For example, the light emitting unit EMU may be configured in a serial/parallel mixed structure.

Figure 5:
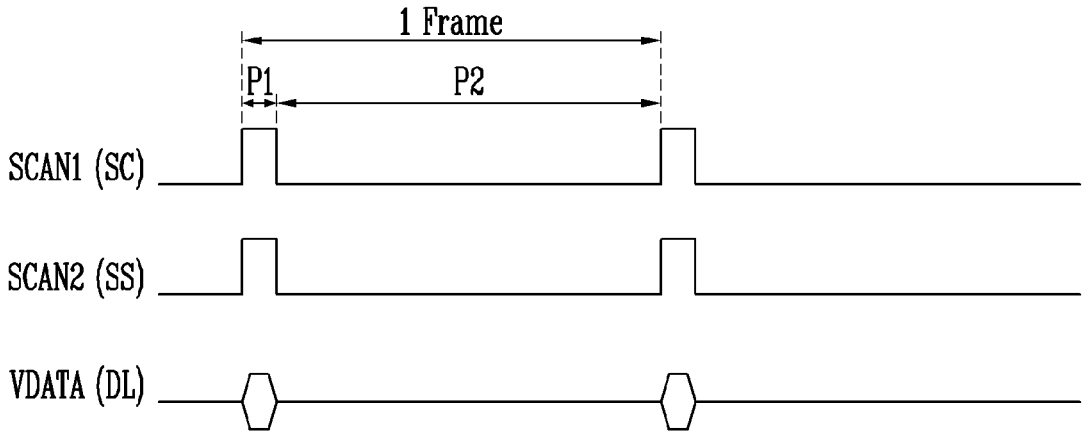
FIG. 5 is a waveform diagram schematically illustrating an operation of the pixel of FIG. 4.

FIG. 5 may be referred to in order to describe an operation of the pixel PXL.

FIG. 5 is a waveform diagram schematically illustrating an operation of the pixel of FIG. 4.

Referring to FIGS. 4 and 5, a first scan signal SCAN1 may be applied to the scan line SC, a second scan signal SCAN2 may be applied to the sensing scan line SS, and a data signal VDATA (or the data voltage) may be applied to the data line DL. One frame (or each of the frames) may include a first period P1 and a second period P2. Here, the first period P1 may be a data write period in which the data signal may be written to the pixel PXL, and the second period P2 may be an emission period in which the pixel PXL emits light in response to the data signal.

In the first period P1, the first scan signal SCAN1 may have a pulse of a gate-on voltage level (or a logic high level). In the first period P1, the second transistor T2 may be turned on in response to the first scan signal SCAN1 of the gate-on voltage level, and the data signal VDATA of the data line DL may be applied to the first node N1. The data signal VDATA may have an effective data value (or voltage level) in the first period P1.

In the first period P1, the second scan signal SCAN2 may have a pulse of a gate-on voltage level. In the first period P1, the third transistor T3 may be turned on in response to the second scan signal SCAN2 of the gate-on voltage level. In case that the initialization voltage is applied to the sensing line RL, the initialization voltage may be applied to the second terminal of the first transistor T1 through the sensing line RL and the third transistor T3. Here, the initialization voltage may be greater than or equal to the voltage of the second driving power VSS. A difference (for example, a potential difference) between the initialization voltage and the voltage of the second driving power VSS may be less than a threshold voltage of the light emitting elements LD, and thus the light emitting element LD may not emit light in the first period P1.

In the first period P1, the storage capacitor Cst may be charged with a voltage corresponding to a difference between the data signal VDATA and the initialization voltage.

In the second period P2, the first scan signal SCAN1 and the second scan signal SCAN2 may have a gate-off voltage level (or a logic low level).

Each of the second transistor T2 and the third transistor T3 may be turned off, and the second terminal of the first transistor T1 may be electrically disconnected from the sensing line RL. In response to the voltage charged in the storage capacitor Cst, a current may flow from the first driving power VDD to the second driving power VSS through the light emitting elements LD, and the light emitting elements LD may emit light with a luminance corresponding to the voltage charged in the storage capacitor Cst.

For example, in the second period P2, the pixel PXL may emit light with the luminance corresponding to the voltage charged in the storage capacitor Cst in the first period P1.

As described with reference to FIG. 3, the luminous efficiency of the light emitting element LD may be changed due to the current stress, and thus the pixel PXL may emit light with a luminance different from a target luminance corresponding to the voltage charged in the storage capacitor Cst. For example, in case that the luminous efficiency of the light emitting element LD is increased due to a relatively high current stress, the pixel PXL may emit light with a luminance higher than the target luminance corresponding to the voltage charged in the storage capacitor Cst. Therefore, the compensator 160 (refer to FIG. 3) may compensate for the input grayscale value GRAY_IN based on the current stress of the light emitting element LD and generate the output grayscale value GRAY_OUT. Accordingly, the voltage corresponding to the output grayscale value GRAY_OUT may be charged in the storage capacitor Cst, and the pixel PXL may emit light with the target luminance.

Figure 6:
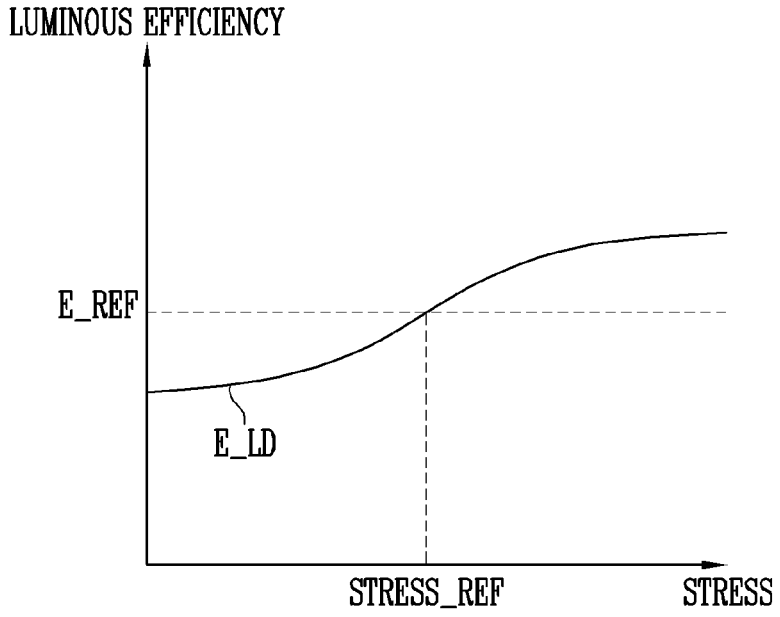
FIG. 6 is a schematic diagram illustrating a change of luminous efficiency of the light emitting element according to a current stress.

FIG. 6 is a schematic diagram illustrating the change of the luminous efficiency of the light emitting element according to the current stress. FIG. 6 schematically shows the change of the luminous efficiency E_LD of the light emitting element according to the current stress STRESS. It may be assumed that the light emitting element LD may be in a sufficiently aged (or stabilized) state and stress (for example, temperature stress) other than the current stress STRESS may not exist or may not be changed.

Referring to FIGS. 1 to 4 and 6, the luminous efficiency E_LD of the light emitting element LD may be changed by the current stress STRESS (or the short-term stress).

In case that the current stress STRESS becomes greater than a reference current stress STRESS_REF, the luminous efficiency E_LD may be increased. In case that the current stress STRESS becomes greater than a specific value (for example, an upper limit value), the luminous efficiency E_LD may be saturated.

As described above, as the hydrogen (H) (or the hydrogen ion (H+)) may be dropped out of the Mg—H (magnesium hydride) composite in the light emitting element LD due to a relatively high current stress STRESS, the Mg dopant may be more activated, and the luminous efficiency of the light emitting element LD may be increased. Since the hydrogen that may be dropped out may be limited, in case that the current stress STRESS is greater than the specific value, the dropout rate of the hydrogen may be saturated, and thus the luminous efficiency E_LD may also be saturated.

In contrast, in case that the current stress STRESS becomes less than the reference current stress STRESS_REF, the luminous efficiency E_LD may be decreased. In case that the current stress STRESS becomes less than a specific value (for example, a lower limit value), the luminous efficiency E_LD may be saturated. As the hydrogen may be combined with the Mg dopant to form the Mg—H composite due to a relatively low current stress STRESS, the Mg dopant may be relatively inactivated, and the luminous efficiency of the light emitting element LD may be decreased.

In FIG. 6, in case that the current stress STRESS has the specific value, the luminous efficiency E_LD may be equal to the reference luminous efficiency E_REF, but this is an example and is not limited thereto. According to an embodiment, the current stress STRESS at which the luminous efficiency E_LD may be equal to the reference luminous efficiency E_REF in FIG. 6 may have a specific range.

Figure 7:
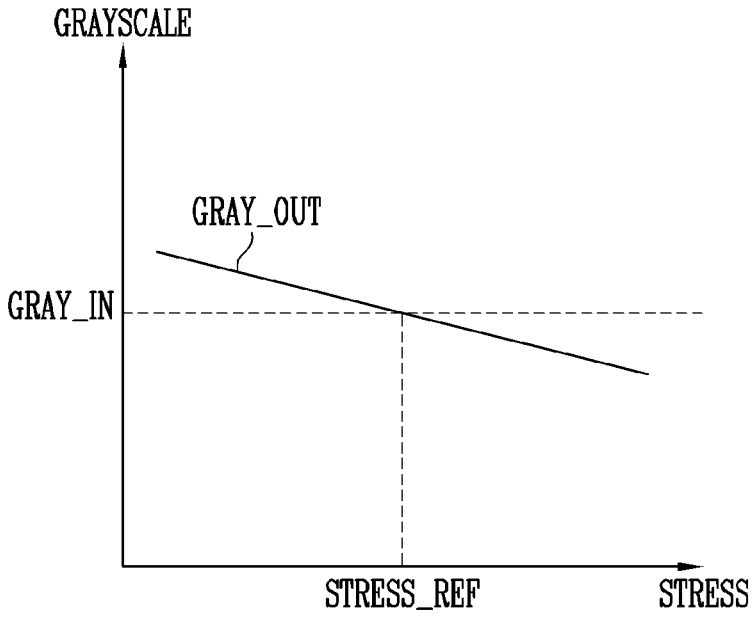
FIG. 7 is a schematic diagram illustrating an operation of a compensator included in the display device of FIG. 3.

FIG. 7 is a schematic diagram illustrating an operation of the compensator included in the display device of FIG. 3. FIG. 7 shows a relationship between the input grayscale value GRAY_IN and the output grayscale value GRAY_OUT according to the current stress.

Referring to FIGS. 3, 6, and 7, in case that the current stress STRESS is greater than the reference current stress STRESS_REF, in response to the increase of the luminous efficiency E_LD, the compensator 160 may convert or compensate for the input grayscale value GRAY_IN to the output grayscale value GRAY_OUT having a relatively small value.

In case that the current stress STRESS becomes less than the reference current stress STRESS_REF, in response to the decrease of the luminous efficiency E_LD, the compensator 160 may convert or compensate for the input grayscale value GRAY_IN to the output grayscale value GRAY_OUT having a relatively large value.

As described above, the luminous efficiency E_LD of the light emitting element LD may be changed according to the current stress STRESS, and the compensator 160 may compensate for the input grayscale value GRAY_IN in consideration of the change of the luminous efficiency E_LD to convert or compensate for the input grayscale value GRAY_IN to the output grayscale value GRAY_OUT.

Figure 8:
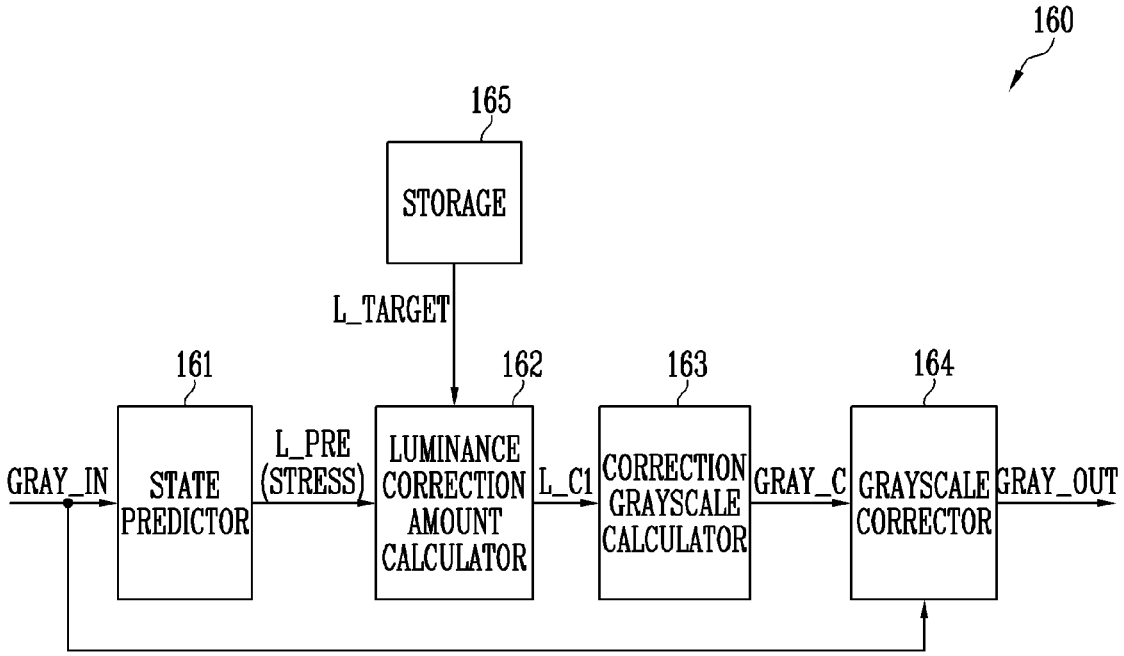
FIG. 8 is a block diagram schematically illustrating an example of the compensator included in the display device of FIG. 3.
Figure 9:
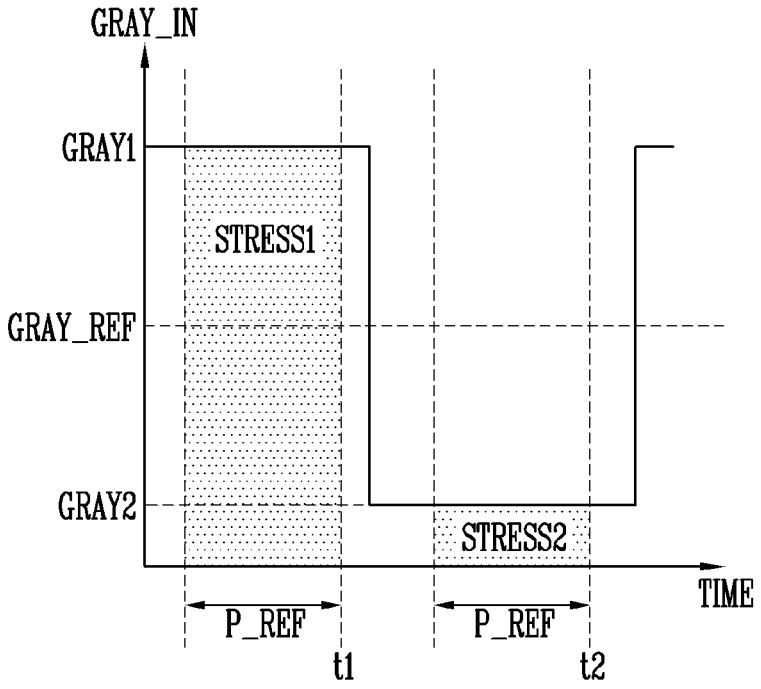
FIG. 9 is a schematic diagram illustrating the current stress calculated by the compensator of FIG. 8.
Figure 10:
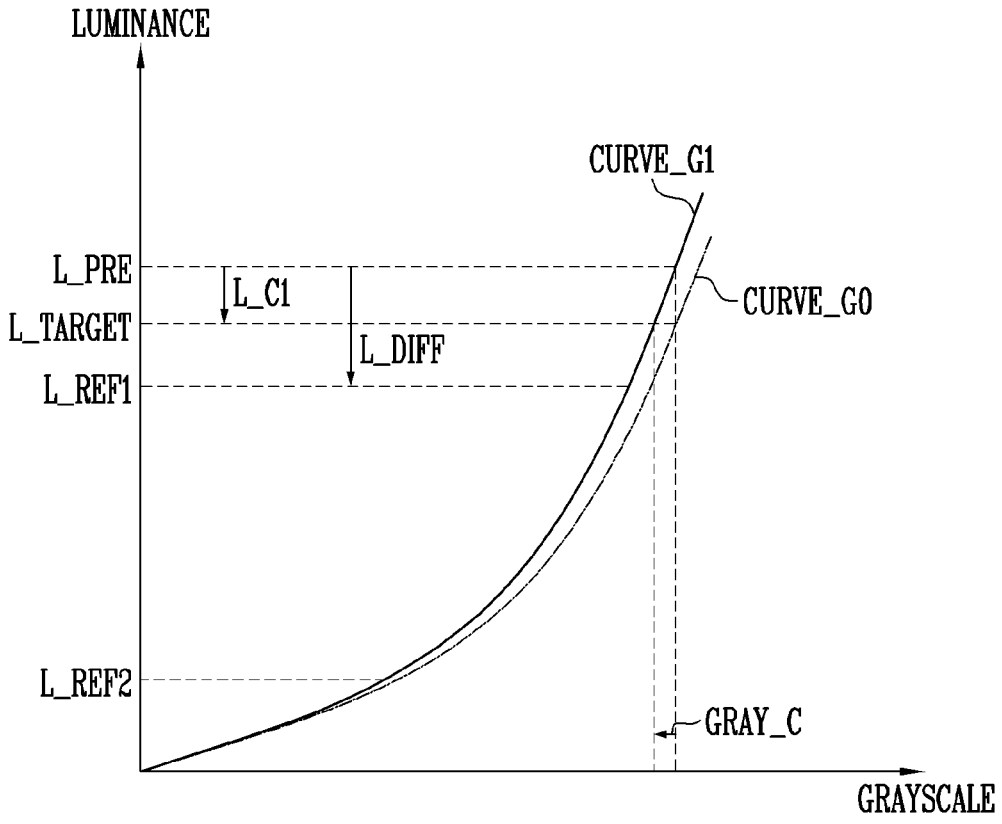
FIG. 10 is a schematic diagram illustrating a correction grayscale calculated by the compensator of FIG. 8.

FIG. 8 is a block diagram schematically illustrating an example of the compensator included in the display device of FIG. 3. FIG. 9 is a schematic diagram illustrating the current stress calculated by the compensator of FIG. 8. FIG. 9 shows the input grayscale value GRAY_IN provided as time passes. FIG. 10 is a schematic diagram illustrating the correction grayscale calculated by the compensator of FIG. 8. FIG. 10 shows gamma curves indicating a luminance according to the grayscale value of the light emitting element.

Referring to FIGS. 3, 8, 9, and 10, the compensator 160 may further include a state predictor 161 (or a state prediction block), a luminance correction amount calculator 162 (or a luminance correction amount calculation block), a correction grayscale calculator 163 (or a correction grayscale calculation block), and a grayscale corrector 164 (or a grayscale correction block). According to an embodiment, the compensator 160 may further include a storage 165 (or a storage block).

The state predictor 161 may calculate the current stress based on the input grayscale value GRAY_IN, and predict or calculate the change of the luminous efficiency of the light emitting element LD according to the current stress.

In embodiments, the state predictor 161 may calculate the current stress STRESS based on the input grayscale values GRAY_IN provided during the specific time until the current time point.

Referring to FIG. 9, for example, at a first time point t1, the state predictor 161 may calculate a first current stress STRESS1 based on first grayscale values GRAY1 provided as the input grayscale value GRAY_IN during a specific time P_REF until the first time point t1. The specific time P_REF may be within several minutes, and the specific time P_REF may be several tens to hundreds frames according to an embodiment. For example, the state predictor 161 may calculate the first current stress STRESS1 by summing the first grayscale values GRAY1 provided during the specific time P_REF until the first time point t1. As another example, the state predictor 161 may calculate the first current stress STRESS1 by assigning a weight to the input grayscale value GRAY_IN provided at a time point adjacent to the first time point t1.

In case that the input grayscale value GRAY_IN (or an average of the input grayscale values GRAY_IN) is greater than the reference grayscale value GRAY_REF, for example, in case that the first grayscale value GRAY1 is greater than the reference grayscale value GRAY_REF, the first current stress STRESS1 may be calculated to be greater than the reference current stress STRESS_REF (refer to FIGS. 6 and 7).

Similarly, at a second time point t2, the state predictor 161 may calculate a second current stress STRESS2 based on second grayscale values GRAY2 provided as the input grayscale value GRAY_IN during the specific time P_REF until the second time point t2. In case that the input grayscale value GRAY Ind. (or an average of the input grayscale values GRAY Ind.) is less than the reference grayscale value GRAY_REF, for example, in case that the second grayscale value GRAY2 is less than the reference grayscale value GRAY_REF, the second current stress STRESS2 may be calculated to be less than the reference current stress STRESS_REF (refer to FIGS. 6 and 7).

For example, a value of the current stress STRESS may be increased or decreased according to a calculation time point within a specific range.

In embodiments, the state predictor 161 may predict or calculate the change of the luminous efficiency of the light emitting element LD or the dropout rate of the hydrogen in the light emitting element LD based on the current stress STRESS.

The change of the luminous efficiency E_LD of the light emitting element LD according to the current stress STRESS described with reference to FIG. 6 (or a graph or a lookup table indicating change of the luminous efficiency E_LD) may be derived through a repeated experiment and stored in the storage 165. The state predictor 161 may predict the change of the luminous efficiency (or the dropout rate of the hydrogen) of the light emitting element LD according to the current stress STRESS based on the graph shown in FIG. 6.

In embodiments, the state predictor 161 may calculate or predict a first luminance L_PRE (or prediction luminance) for the input grayscale value GRAY_IN input at the current time point based on the change of the luminous efficiency of the light emitting element LD.

For example, the state predictor 161 may derive a first gamma curve CURVE_G1 based on the change of the luminous efficiency of the light emitting element LD, and predict the first luminance L_PRE corresponding to the input grayscale value GRAY_IN based on the first gamma curve CURVE_G1. For example, the first gamma curve CURVE_G1 according to the change of the luminous efficiency of the light emitting element LD may be derived from a reference gamma curve CURVE_G0. As another example, the gamma curves (or information thereof) for each luminous efficiency of the light emitting element LD may be pre-stored in the storage 165, and a gamma curve (for example, the first gamma curve (CURVE_G1)) corresponding to a specific luminous efficiency may be selected.

The luminance correction amount calculator 162 may calculate a first luminance correction amount L_C1 based on the first luminance L_PRE predicted by the state predictor 161 and a target luminance L_TARGET. For example, the target luminance L_TARGET for the input grayscale value GRAY may be derived from the reference gamma curve CURVE_G0 or provided from the storage 165.

Referring to FIG. 10, for example, the luminance correction amount calculator 162 may calculate the first luminance correction amount L_C1 by performing a difference calculation between the first luminance L_PRE and the target luminance L_TARGET.

In FIG. 10, the first luminance L_PRE may be greater than the target luminance L_TARGET and the first luminance correction amount L_C1 has a negative value, but this is an example of a case where the current stress may be relatively large, and the disclosure is not limited thereto. For example, in case that the current stress STRESS is relatively small, the first luminance L_PRE may be less than the target luminance L_TARGET, and thus the first luminance correction amount L_C1 may have a positive value.

Although it has been described that the luminance correction amount calculator 162 calculates the first luminance correction amount L_C1 based on the first luminance L_PRE and the target luminance L_TARGET, the disclosure is not limited thereto. For example, in case that a luminance correction amount lookup table including information on the first luminance correction amount L_C1 for each current stress STRESS and input grayscale value GRAY_IN is previously set, the luminance correction amount calculator 162 may calculate the first luminance correction amount L_C1 based on the current stress STRESS) and the input grayscale value GRAY_IN.

The correction grayscale calculator 163 may calculate a correction grayscale GRAY_C (or a grayscale compensation value) based on the first luminance correction amount.

Referring to FIG. 10, for example, the correction grayscale calculator 163 may calculate the correction grayscale GRAY_C corresponding to the first luminance correction amount L_C1 based on the first gamma curve CURVE_G1. For example, the correction grayscale GRAY_C may have a negative value.

According to a characteristic of the driving transistor (for example, the first transistor T1, refer to FIG. 4) provided in each of the pixels, a value of the correction grayscale GRAY_C may be different for each pixel even though the first luminance correction amount L_C1 may be the same. Therefore, the correction grayscale calculator 163 may calculate the correction grayscale GRAY_C by additionally considering the characteristic of the driving transistor.

The grayscale corrector 164 may calculate the output grayscale value GRAY_OUT by correcting the input grayscale value GRAY_IN based on the correction grayscale GRAY_C. For example, the grayscale corrector 164 may calculate the output grayscale value GRAY_OUT by adding the correction grayscale GRAY_C to the input grayscale value GRAY_IN. In case that the current stress STRESS is relatively large, the correction grayscale GRAY_C may have a negative value, and the output grayscale value GRAY_OUT may be less than the input grayscale value GRAY_IN. In contrast, in case that the current stress STRESS is relatively small, the correction grayscale GRAY_C may have a positive value, and the output grayscale value GRAY_OUT may be greater than the input grayscale value GRAY_IN.

As described above, the compensator 160 may calculate the current stress STRESS of the light emitting element LD in the pixel PXL based on the input grayscale values GRAY_IN provided during the specific time, predict or calculate the change of the luminous efficiency of the light emitting element LD (or the dropout rate of the hydrogen in the light emitting element LD) based on the current stress STRESS, calculate the first luminance correction amount L_C1 (and the correction grayscale GRAY_C) based on the change of the luminous efficiency of the light emitting element LD, and convert or compensate for the input grayscale value GRAY_IN to the output grayscale value GRAY_OUT based on the first luminance correction amount L_C1. Therefore, even though the luminous efficiency of the pixel PXL (or the light emitting element LD) may be changed due to the current stress STRESS, the pixel PXL may accurately emit light with the target luminance L_TARGET.

Figure 11:
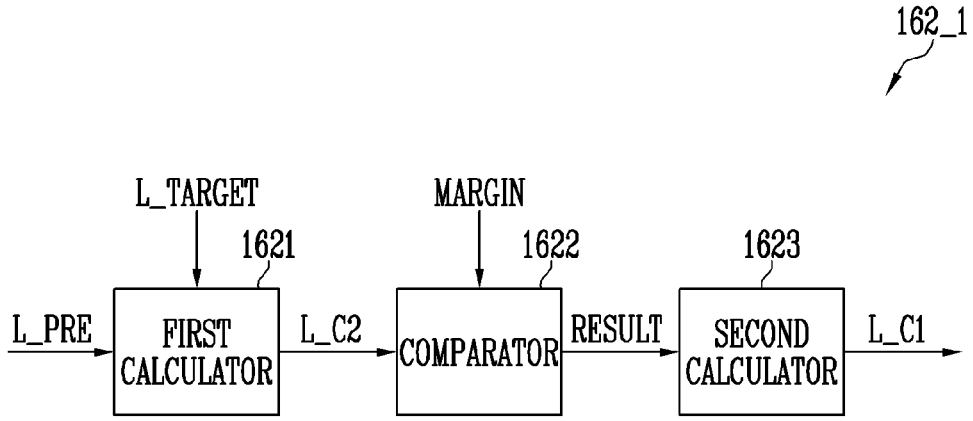
FIG. 11 is a block diagram schematically illustrating an example of a luminance correction amount calculator included in the compensator of FIG. 8.

FIG. 11 is a block diagram schematically illustrating an example of the luminance correction amount calculator included in the compensator of FIG. 8.

Referring to FIGS. 8 to 11, the luminance correction amount calculator 162_1 may calculate the first luminance correction amount L_C1 in consideration of a margin MARGIN. Here, the margin MARGIN may be a range set so that an excessive current stress state may not be maintained continuously (for example, a range set so that the dropout of the hydrogen may not occur continuously). For example, the margin MARGIN may be a luminance range (or the luminance correction request range) to allow the current stress calculated by the state predictor 161 to exist within a reference range, or a range in which fluctuation of the current stress STRESS may be required in correspondence with the luminance range. For example, the margin MARGIN may correspond to a range less than or equal to a first reference luminance L_REF1 shown in FIG. 10, or may correspond to a luminance difference L_DIFF between the first luminance L_PRE and the first reference luminance L_REF1. The first reference luminance L_REF1 may be a maximum luminance set so that a relatively large current stress STRESS may not occur continuously, and the luminance difference L_DIFF may be a minimum luminance correction request amount for which luminance correction may be required in correspondence with the maximum luminance. As another example, the margin MARGIN may correspond to a range greater than or equal to a second reference luminance L_REF2 shown in FIG. 10. The second reference luminance L_REF2 may be a minimum luminance set so that a relatively small current stress STRESS may not occur continuously. The margin MARGIN may be preset for each current stress STRESS, or may be calculated together with the current stress STRESS (the first luminance L_PRE, or a prediction luminance) by the state predictor 161.

For reference, in case that a specific current stress STRESS occurs continuously (for example, in case that the dropout of the hydrogen in the light emitting element LD occurs continuously), correction (or control) for the luminance of the light emitting element LD may be impossible, and in some cases, a defect may occur in the light emitting element LD or the luminous efficiency of the light emitting element LD may be greatly reduced. In order to prevent a defect or the like of the light emitting element LD, the luminance correction amount calculator 162_1 may calculate the first luminance correction amount L_C1 in consideration of the margin MARGIN.

The luminance correction amount calculator 162_1 may include a first calculator 1621 (or a first calculation block), a comparator 1622 (or a comparison block), and a second calculator 1623 (or a second calculation block).

Similarly to the luminance correction amount calculator 162 described with reference to FIG. 8, the first calculator 1621 may calculate a second luminance correction amount L_C2 based on the first luminance L_PRE predicted by the state predictor 161 and the target luminance L_TARGET.

The comparator 1622 may compare the second luminance correction amount L_C2 and the margin MARGIN (or the luminance correction request range) and output a comparison result RESULT. The margin MARGIN may be provided from the storage 165 (refer to FIG. 8) or from the state predictor 161 (refer to FIG. 8). Referring to FIG. 11, for example, the comparator 1622 may compare the second luminance correction amount L_C2 with the luminance difference L_DIFF and output the comparison result RESULT. For example, the comparator 1622 may determine whether the second luminance correction amount L_C2 may be greater than the luminance difference L_DIFF.

The second calculator 1623 may determine or calculate the first luminance correction amount L_C1 based on the comparison result of the comparator 1622.

For example, in case that the second luminance correction amount L_C2 is greater than the luminance difference L_DIFF, the second calculator 1623 may determine the second luminance correction amount L_C2 as the first luminance correction amount L_C1. For example, since the current stress STRESS may be adjusted within the reference range only by correcting the grayscale value corresponding to the second luminance correction amount L_C2, the second calculator 1623 may determine the second luminance correction amount L_C2 as the first luminance correction amount L_C1.

As another example, in case that the second luminance correction amount L_C2 is less than the luminance difference L_DIFF, the second calculator 1623 may determine the luminance difference L_DIFF (or a third luminance correction amount) as the first luminance correction amount L_C1. For example, since the current stress STRESS may not be adjusted within the reference range only by correcting the grayscale value corresponding to the second luminance correction amount L_C2, the second calculator 1623 may determine the luminance difference L_DIFF greater than the second luminance correction amount L_C2 as the first luminance correction amount L_C1. The correction grayscale GRAY_C may become relatively large, the output grayscale value GRAY_OUT reflecting the correction grayscale GRAY_C may be changed to be greater than the input grayscale value GRAY_IN, and the pixel PXL (or light emitting element (LD)) may emit light with a luminance (for example, the first reference luminance L_REF1) different from the target luminance L_TARGET. For example, in case that a maximum grayscale value corresponding to the maximum luminance is continuously provided as the input grayscale value GRAY_IN during several hundred frames, the luminance correction amount calculator 162_1 may calculate the first luminance correction amount L_C1 to be relatively large during at least one frame, and thus the pixel PXL may emit light with a luminance lower than the maximum luminance during at least one frame.

As described above, in order to prevent the current stress STRESS of the light emitting element LD from being continuously maintained in a specific state (for example, so that the dropout of the hydrogen in the light emitting element LD may not occur continuously), in some cases, the luminance correction amount calculator 162_1 may additionally adjust (for example, increase or decrease) the luminance correction amount. Accordingly, in some cases, the pixel PXL (or the light emitting element LD) may emit light with the luminance different from the target luminance L_TARGET. For example, the luminance correction amount calculator 162_1 may additionally adjust the luminance correction amount to manage the current stress STRESS.

Figure 12:
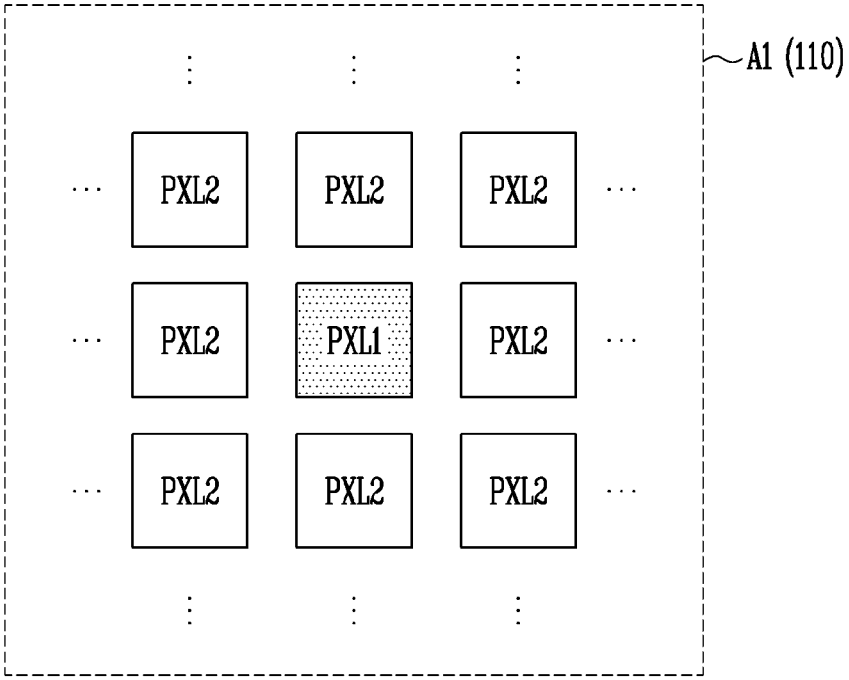
FIG. 12 is a schematic diagram illustrating an example of a display unit included in the display device of FIG. 3.
Figure 13:
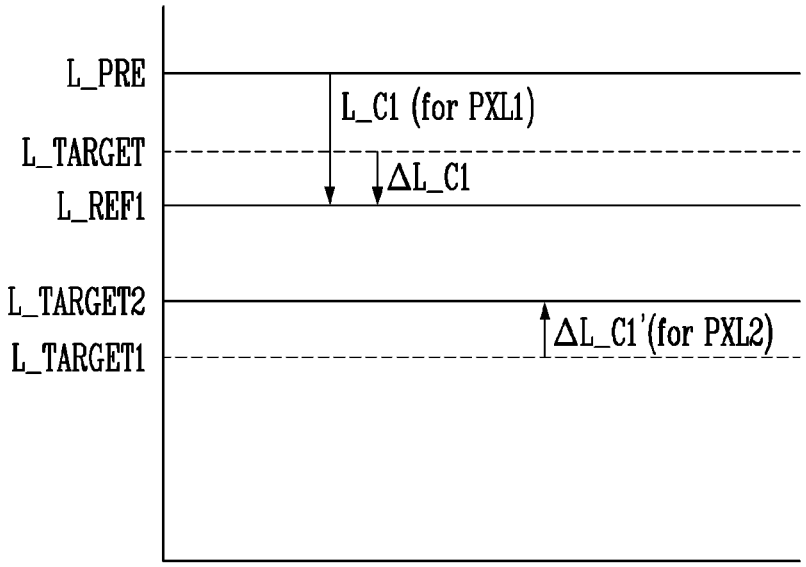
FIG. 13 is a schematic diagram illustrating another operation of a luminance correction amount calculator of FIG. 11.

FIG. 12 is a schematic diagram illustrating an example of the display unit included in the display device of FIG. 3. FIG. 13 is a schematic diagram illustrating another operation of the luminance correction amount calculator of FIG. 11. FIG. 13 shows a diagram corresponding to FIG. 11.

Referring to FIGS. 3, 8, and 11 to 13, a first area A1 of the display unit 110 may include a first pixel PXL1 and second pixels PXL2 (or adjacent pixels) adjacent to the first pixel PXL1. Each of the first pixel PXL and the second pixels PXL2 may be substantially the same as the pixel PXL described with reference to FIGS. 3 and 4.

The luminance correction amount calculator 162_1 (or the second calculator 1623) of FIG. 11 may adjust a first luminance correction amount of at least one of the second pixels PXL2 based on the first luminance correction amount L_C1 of the first pixel PXL1.

Referring to FIG. 13, for example, the luminance correction amount calculator 162_1 may determine the first luminance correction amount L_C1 of the first pixel PXL1, based on the difference between the first luminance L_PRE and the first reference luminance L_REF1, not the difference between the first luminance L_PRE and the target luminance L_TARGET, in consideration of the margin MARGIN of the current stress STRESS of the first pixel PXL1. For example, the luminance correction amount calculator 162_1 may determine the first luminance correction amount L_C1 for the first pixel PXL1, to which a first additional correction amount ΔL_C1 corresponding to the difference between the target luminance L_TARGET and the first reference luminance L_REF1 may be added. The first pixel PXL1 may emit light with a luminance lower than the target luminance L_TARGET, and in some cases, a luminance fluctuation of the first pixel PXL1 (or a luminance fluctuation of the first area A1, for example, a luminance decrease) may be visually recognized by a user.

Therefore, the luminance correction amount calculator 162_1 may reflect a first additional correction amount ΔL_C1' corresponding to the first additional correction amount ΔL_C1 for the first pixel PXL1 to the luminance correction amount for at least one of the second pixels PXL2. Here, at least one of the second pixels PXL2 may be a pixel capable of additional luminance correction. For example, the luminance correction amount calculator 162_1 may increase the luminance correction amount of the second pixel PXL2 by the first additional correction amount ΔL_C1', in response to a luminance decrease by the first additional correction amount ΔL_C1 of the first pixel PXL1. The second pixel PXL2 may emit light with a second target luminance L_TARGET2 higher than the first target luminance L_TARGET1 corresponding to the input grayscale value by the first additional correction amount ΔL_C1'. Therefore, the entire luminance of the first area A1 may not be changed.

As described above, the luminance correction amount calculator 162_1 (or the compensator 160) may also additionally correct the luminance of the second pixel PXL2 (for example, the pixel adjacent to the first pixel PXL1 and capable of additional luminance correction) by the first additional correction amount ΔL_C1', in correspondence with the first additional correction amount ΔL_C1 for the first pixel PXL1. The luminance of the first area A1 including the first pixel PXL1 may not be changed, and the luminance fluctuation of the first pixel PXL1 may not be visually recognized by the user.

Figure 14:
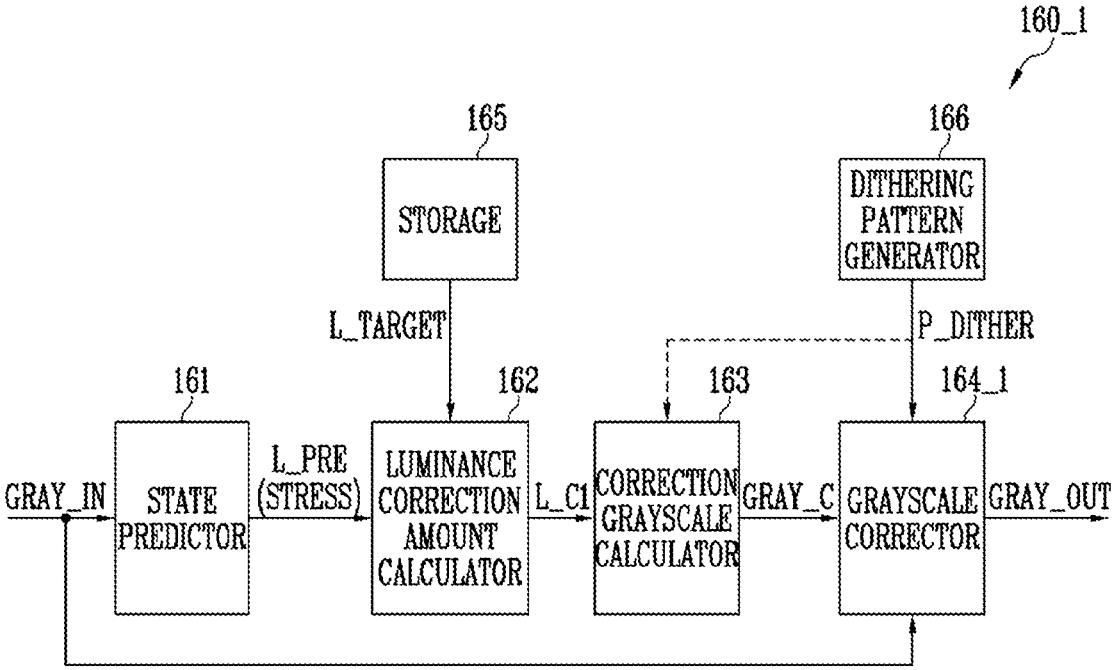
FIG. 14 is a block diagram schematically illustrating another example of the compensator included in the display device of FIG. 3.
Figure 15:
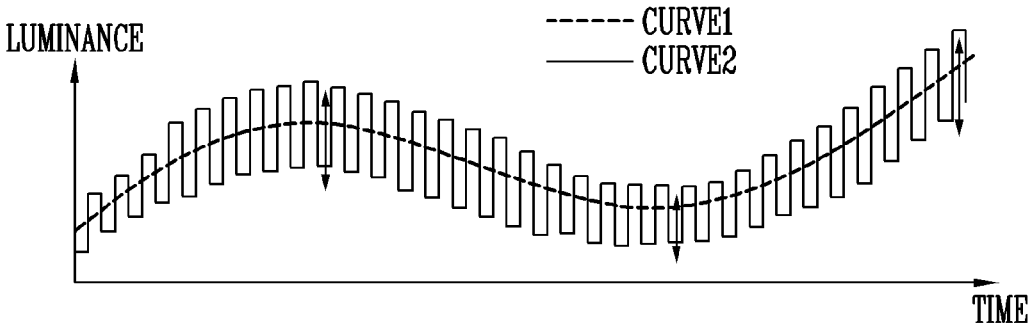
FIG. 15 is a schematic diagram illustrating an operation of the compensator of FIG. 14.

FIG. 14 is a block diagram schematically illustrating another example of the compensator included in the display device of FIG. 3. FIG. 15 is a schematic diagram illustrating an operation of the compensator of FIG. 14. FIG. 15 shows a change of a luminance of one pixel PXL according to a time.

Referring to FIGS. 3, 8, 14, and 15, the compensator 160_1 may be different from the compensator 160 of FIG. 8 in that the compensator 160_1 further includes a dithering pattern generator 166 (or a dithering pattern generation block). Except for the dithering pattern generator 166, a configuration of the compensator 160_1 may be substantially the same as or similar to a configuration of the compensator 160 of FIG. 8, and thus a repetitive description is omitted.

The dithering pattern generator 166 may generate a dithering pattern P_DITHER. Here, the dithering pattern P_DITHER may have a negative (or, negative value) additional correction grayscale and/or a positive (or positive value) additional correction grayscale for each specific period (for example, at least one frame).

A grayscale corrector 164_1 may calculate the output grayscale value GRAY_OUT by correcting the input grayscale value GRAY_IN based on the correction grayscale GRAY_C and the dithering pattern P_DITHER. For example, the grayscale corrector 164 may calculate the output grayscale value GRAY_OUT by adding the correction grayscale GRAY_C and the negative additional correction grayscale to the input grayscale value GRAY_IN. The luminance of the pixel PXL corresponding to the output grayscale value GRAY_OUT may be lower than the target luminance L_TARGET. For example, the luminance of the pixel PXL may become periodically lower than the target luminance as time passes due to the dithering pattern P_DITHER. As another example, the grayscale corrector 164 may calculate the output grayscale value GRAY_OUT by adding the correction grayscale GRAY_C and the positive additional correction grayscale to the input grayscale value GRAY_IN. The luminance of the pixel PXL corresponding to the output grayscale value GRAY_OUT may be higher than the target luminance L_TARGET. For example, the luminance of the pixel PXL may become periodically higher than the target luminance as time passes due to the dithering pattern P_DITHER. In case that the dithering pattern P_DITHER alternately has the negative additional correction grayscale and the and positive additional correction grayscale, the luminance of the pixel PXL may become repeatedly higher or lower than the target luminance as time passes due to the dithering pattern P_DITHER.

Referring to FIG. 15, a first curve CURVE1 may indicate the target luminance L_TARGET of the pixel PXL according to the input grayscale value GRAY_IN, and the second curve CURVE2 may indicate an actual luminance of the pixel PXL according to the dithering pattern P_DITHER. As shown in FIG. 15, the actual luminance of the pixel PXL may become periodically higher or lower than the target luminance.

Similar to the margin MARGIN described with reference to FIG. 11, the compensator 160_1 may control the output grayscale value GRAY_OUT to have a relatively low grayscale value periodically so that the current stress STRESS of the light emitting element LD of the pixel PXL may not be continuously maintained in a specific state (for example, the dropout of the hydrogen may not occur continuously).

In case that the first pixel PXL1 and the second pixels PXL2 described with reference to FIG. 12 are simultaneously higher or lower than the target luminance, the luminance fluctuation of the first area A1 may occur, and thus a dithering pattern different from the dithering pattern P_DITHER used for the first pixel PXL1 may be applied to at least some of the second pixels PXL2. For example, in case that the positive additional grayscale is applied to the output grayscale value GRAY_OUT for the first pixel PXL1, the negative additional grayscale may be applied to the output grayscale value GRAY_OUT for at least some of the second pixels PXL2. The entire luminance of the first area A1 may not be changed.

As described above, the compensator 160_1 may control the output grayscale value GRAY_OUT to have a relatively low grayscale value periodically using the dithering pattern P_DITHER, so that the current stress STRESS of the light emitting element LD of the pixel PXL may be managed so as not to be continuously maintained in a specific state.

In FIG. 14, the dithering pattern P_DITHER may be provided to the grayscale corrector 164_1, but embodiments are not limited thereto. For example, the dithering pattern P_DITHER may be provided to the correction grayscale calculator 163 instead of the grayscale corrector 164_1, and the correction grayscale calculator may calculate the correction grayscale GRAY_C by reflecting the dithering pattern P_DITHER (for example, the positive or negative additional correction grayscale). As another example, the dithering pattern P_DITHER may be provided to the luminance correction amount calculator 162, and the luminance correction amount calculator 162 may calculate the first luminance correction amount L_C1 by reflecting the dithering pattern P_DITHER.

Figure 16:
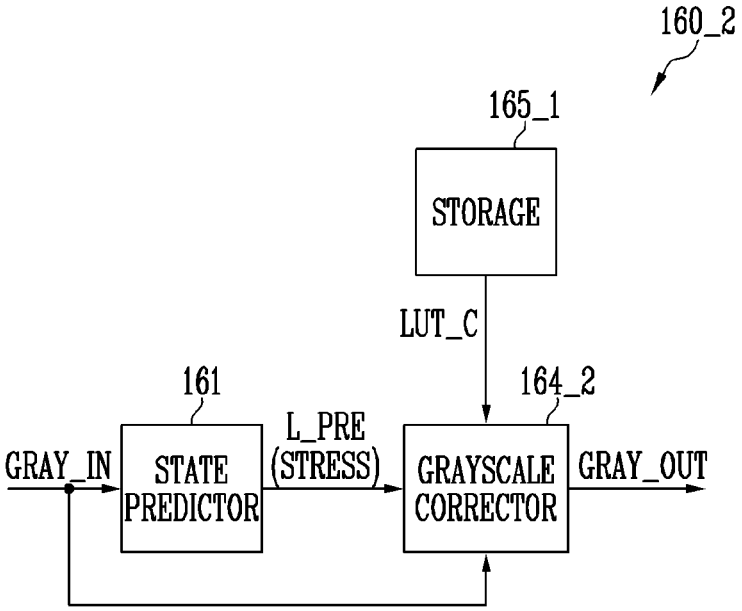
FIG. 16 is a block diagram schematically illustrating another example of the compensator included in the display device of FIG. 3.

FIG. 16 is a block diagram schematically illustrating another example of the compensator included in the display device of FIG. 3.

Referring to FIGS. 3, 8, and 16, the compensator 160_2 may be different from the compensator 160 of FIG. 8 in that the compensator 160_2 may not include the luminance correction amount calculator 162 and the correction grayscale calculator 163. Since the state predictor 161, a grayscale corrector 164_2, and a storage 165_1 are substantially the same or similar to the state predictor 161, the grayscale corrector 164, and the storage 165 described with reference to FIG. 8, respectively, a repetitive description is omitted.

The grayscale corrector 164_2 may convert the input grayscale value GRAY_IN to the output grayscale value GRAY_OUT or calculate the output grayscale value GRAY_OUT based on the first luminance L_PRE (or the current stress STRESS of the light emitting element of the pixel PXL) and a compensation lookup table LUT_C. Here, the first luminance L_PRE (or current stress STRESS) may be provided from the state predictor 161. The lookup table LUT_C may include information on the output grayscale value GRAY_OUT (or the correction grayscale GRAY_C described with reference to FIG. 8) corresponding to the input grayscale value GRAY_IN for each first luminance L_PRE (or the current stress STRESS). For example, the lookup table LUT_C may be derived through the repeated experiment using the compensator 160 (or the luminance correction amount calculator 162 and the correction grayscale calculator 163) described with reference to FIG. 8, and may be pre-stored in the storage 165_1.

Although the disclosure has been described with reference to the embodiments above, those skilled in the art will understand that the disclosure may be variously modified and changed without departing from the spirit and technical area of the disclosure described in the claims.

Therefore, the technical scope of the disclosure should not be limited to the contents described in the detailed description of the specification, but should be defined by the claims including equivalents thereof.

What is claimed is:

1. A display device comprising:

a display panel including a pixel including a light emitting element;

a compensator that calculates a current stress of the light emitting element based on input grayscale values sequentially provided for the pixel during a specific time, and generates a first output grayscale value by compensating for a first input grayscale value provided at a current time point based on the current stress; and a driver that generates a data signal based on the first output grayscale value and supplies the data signal to the pixel, wherein a luminance of the pixel varies according to a voltage level of the data signal, wherein the compensator sets the first output grayscale value to be less than the first input grayscale value in case that the input grayscale values are greater than a reference grayscale value, the light emitting element includes a material of an inorganic crystal structure, the compensator predicts a change of luminous efficiency of the light emitting element based on the current stress of the light emitting element, and compensates for the first input grayscale value based on the change of the luminous efficiency, and the compensator determines at the luminous efficiency of the light emitting element increases as the current stress increases.

2. The display device according to claim 1, wherein the specific time is a period within several minutes based on the current time point.

3. The display device according to claim 1, wherein the compensator determines that the current stress is greater than a reference current stress in case that the input grayscale values are greater than the reference grayscale value, and sets the first output grayscale value to be less than the first input grayscale value.

4. The display device according to claim 1, wherein the compensator determines that the current stress is less than a reference current stress in case that the input grayscale values are less than the reference grayscale value, and sets the first output grayscale value to be greater than the first input grayscale value.

5. The display device according to claim 1, wherein the compensator comprises:

a state predictor that calculates a first luminance for the first input grayscale value based on the change of the luminous efficiency of the light emitting element;

a luminance correction amount calculator that calculates a first luminance correction amount by comparing a target luminance and the first luminance;

a correction grayscale calculator that calculates a correction grayscale based on the first luminance correction amount; and a grayscale corrector that calculates the first output grayscale value by correcting the first input grayscale value based on the correction grayscale.

6. The display device according to claim 5, wherein the state predictor calculates the current stress by summing the input grayscale values.

7. The display device according to claim 5, wherein the state predictor calculates the current stress by weighting and summing the input grayscale values as time passes.

8. The display device according to claim 5, wherein the luminance correction amount calculator comprises:

a first calculator that calculates a second luminance correction amount by comparing the target luminance and the first luminance;

a comparator that outputs a first comparison result by comparing the second luminance correction amount and a luminance correction request range; and a second calculator that calculates the first luminance correction amount based on the first comparison result.

9. The display device according to claim 8, wherein the second calculator determines a third luminance correction amount within the luminance correction request range as the first luminance correction amount in case that the second luminance correction amount is out of the luminance correction request range, and an output luminance of the pixel is different from the target luminance corresponding to the first input grayscale value.

10. The display device according to claim 9, wherein the display panel further includes an adjacent pixel adjacent to the pixel, and the luminance correction amount calculator calculates a luminance correction amount of the adjacent pixel based on a difference between the third luminance correction amount and the first luminance correction amount before being determined in case that the third luminance correction amount is determined as the first luminance correction amount for the pixel.

11. The display device according to claim 5, wherein:

the compensator further includes a dithering pattern generator that generates a dithering pattern periodically including a negative additional correction grayscale, the grayscale corrector calculates the first output grayscale value by correcting the first input grayscale value based on the correction grayscale and the dithering pattern, and the luminance of the pixel is lower than the target luminance as time passes due to the dithering pattern.

12. The display device according to claim 11, wherein the dithering pattern includes the negative additional correction grayscale and a positive additional correction grayscale, and the luminance of the pixel is lower or higher than the target luminance as time passes due to the dithering pattern.

13. The display device according to claim 1, wherein the compensator comprises:

a state predictor that calculates a first luminance for the first input grayscale value based on the change of the luminous efficiency of the light emitting element; and a grayscale corrector that calculates the first output grayscale value based on a compensation lookup table, and the compensation lookup table includes information on the first input grayscale value and the first output grayscale value respectively corresponding to the first luminance.

14. The display device according to claim 1, wherein the display panel includes a plurality of pixels, each pixel including a light emitting element, and the compensator calculates a current stress of individual light emitting elements based on input grayscale values sequentially provided for a respective pixel during a specific time and generates a first output grayscale value for each individual light emitting element by compensating for a first input grayscale value provided at a current time point based on the current stress.

15. A display device comprising:

a display panel including a pixel including an inorganic light emitting element;

a compensator that generates a first output grayscale value by compensating for a first input grayscale value provided at a current time point, based on input grayscale values sequentially provided for the pixel during a specific time; and a driver that generates a data signal based on the first output grayscale value and supplies the data signal to the pixel, wherein a luminance of the pixel varies according to a voltage level of the data signal, and the compensator sets the first output grayscale value to be less than the first input grayscale value in case that the input grayscale values are greater than a reference grayscale value, the compensator predicts a change of luminous efficiency of the inorganic light emitting element based on the input grayscale values, and compensates for the first input grayscale value based on the change of the luminous efficiency, and the compensator determines that the luminous efficiency of the inorganic light emitting element increases as the input grayscale values increases.

16. The display device according to claim 15, wherein the specific time is a period within several minutes based on the current time point.

17. The display device according to claim 16, wherein the compensator sets the first output grayscale value to be greater than the first input grayscale value in case that the input grayscale values are less than the reference grayscale value.

* * * * *